US009641929B2

(12) United States Patent
Li et al.

(10) Patent No.: US 9,641,929 B2
(45) Date of Patent: May 2, 2017

(54) AUDIO SIGNAL PROCESSING METHOD AND APPARATUS AND DIFFERENTIAL BEAMFORMING METHOD AND APPARATUS

(71) Applicant: Huawei Technologies Co., Ltd., Shenzhen (CN)

(72) Inventors: Haiting Li, Beijing (CN); Deming Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 15/049,515

(22) Filed: Feb. 22, 2016

(65) Prior Publication Data

US 2016/0173978 A1 Jun. 16, 2016

Related U.S. Application Data

(63) Continuation of application No. PCT/CN2014/076127, filed on Apr. 24, 2014.

(30) Foreign Application Priority Data

Sep. 18, 2013 (CN) ..... 2013 1 0430978

(51) Int. Cl.
*H04R 3/00* (2006.01)
*H04R 1/40* (2006.01)
(Continued)

(52) U.S. Cl.
CPC ..... *H04R 1/406* (2013.01); *G10L 21/02* (2013.01); *G10L 21/0205* (2013.01);
(Continued)

(58) Field of Classification Search
CPC .. H04R 1/092; H04R 1/406; H04R 2201/025; H04R 2430/21; G10L 21/02;
(Continued)

(56) References Cited

U.S. PATENT DOCUMENTS 7,826,623 B2 11/2010 Christoph
2006/0222184 A1 10/2006 Buck et al.
(Continued)

FOREIGN PATENT DOCUMENTS

CN 1267445 A 9/2000
CN 1753084 A 3/2006
(Continued)

OTHER PUBLICATIONS

Foreign Communication From a Counterpart Application, PCT Application No. PCT/CN2014/076127, English Translation of International Search Report dated Jul. 29, 2014, 2 pages.
(Continued)

*Primary Examiner* — Vivian Chin
*Assistant Examiner* — Ammar Hamid
(74) *Attorney, Agent, or Firm* — Quarles & Brady LLP

(57) ABSTRACT

An audio signal processing method and apparatus and a differential beamforming method and apparatus to resolve a problem that an existing audio signal processing system cannot process audio signals in multiple application scenarios at the same time. The method includes determining a super-directional differential beamforming weighting coefficient, acquiring an audio input signal and determining a current application scenario and an audio output signal, acquiring, a weighting coefficient corresponding to the current application scenario, performing super-directional differential beamforming processing on the audio input signal using the acquired weighting coefficient in order to obtain a super-directional differential beamforming signal in the current application scenario, and performing processing on the formed signal to obtain a final audio signal required by the current application scenario. By using this method, a requirement that different application scenarios require different audio signal processing manners can be met.

17 Claims, 17 Drawing Sheets

(51) Int. Cl.

| | |
|---|---|
| ***G10L 21/02*** | (2013.01) |
| *H04R 1/02* | (2006.01) |
| *G10L 21/0216* | (2013.01) |
| *G10L 21/0208* | (2013.01) |

(52) U.S. Cl.
CPC ..... *G10L 2021/02082* (2013.01); *G10L 2021/02166* (2013.01); *H04R 2201/025* (2013.01); *H04R 2201/405* (2013.01); *H04R 2430/21* (2013.01)

(58) Field of Classification Search
CPC ..... G10L 21/0205; G10L 2021/02082; G10L 2021/02166; G10L 2201/025; G10L 2201/405; G10L 2430/21; G10L 2021/0282
USPC ..... 381/92, 91
See application file for complete search history.

(56) References Cited

U.S. PATENT DOCUMENTS

| | | | | |
|---|---|---|---|---|
| 2011/0222701 | A1* | 9/2011 | Donaldson | H04R 1/1083 381/74 |
| 2012/0114128 | A1 | 5/2012 | Derkx et al. | |
| 2012/0330653 | A1 | 12/2012 | Lissek et al. | |
| 2013/0083943 | A1 | 4/2013 | Sorensen et al. | |
| 2013/0343549 | A1* | 12/2013 | Vemireddy | H04R 5/027 381/17 |
| 2014/0270217 | A1* | 9/2014 | Ivanov | H04R 29/005 381/66 |
| 2014/0270248 | A1* | 9/2014 | Ivanov | H04R 3/005 381/92 |

FOREIGN PATENT DOCUMENTS

| | | | |
|---|---|---|---|
| CN | 101964934 | A | 2/2011 |
| CN | 102164328 | A | 8/2011 |
| CN | 102474680 | A | 5/2012 |
| CN | 103065639 | A | 4/2013 |
| EP | 0820210 | A2 | 1/1998 |
| WO | 2005004532 | A1 | 1/2005 |

OTHER PUBLICATIONS

Foreign Communication From a Counterpart Application, PCT Application No. PCT/CN2014/076127, English Translation of Written Opinion dated Jul. 29, 2014, 12 pages.

* cited by examiner

AUDIO SIGNAL PROCESSING METHOD AND APPARATUS AND DIFFERENTIAL BEAMFORMING METHOD AND APPARATUS

CROSS-REFERENCE TO RELATED APPLICATIONS

This application is a continuation of International Application No. PCT/CN2014/076127, filed on Apr. 24, 2014, which claims priority to Chinese Patent Application No. 201310430978.7, filed on Sep. 18, 2013, both of which are hereby incorporated by reference in their entireties.

TECHNICAL FIELD

The present disclosure relates to the field of audio technologies, and in particular, to an audio signal processing method and apparatus and a differential beamforming method and apparatus.

BACKGROUND

With continuous development of microphone array processing technologies, a microphone array is widely applied to collecting an audio signal. For example, the microphone array may be applied in multiple application scenarios, such as a high definition call, an audio and video conference, voice interaction, and spatial sound field recording, and is gradually applied in more extensive application scenarios, such as an in-vehicle system, a home media system, and a video conference system.

Generally, in different application scenarios, there are different audio signal processing apparatuses, and different microphone array processing technologies are used. For example, in a high performance human computer interaction scenario and a high definition voice communication scenario that require a mono signal, a microphone array based on an adaptive beamforming technology is generally used to collect an audio signal, and after the audio signal collected by the microphone array is processed, a mono signal is output, that is, this audio signal processing system used to output a mono signal can be used to acquire only a mono signal, but cannot be applied in a scenario that requires a dual-channel signal. For example, this audio signal processing system cannot implement spatial sound field recording.

With development of an integration process, a terminal that integrates multiple functions such as a high definition call, an audio and video conference, voice interaction, and spatial sound field recording has been applied. When the terminal works in different application scenarios, different microphone array processing systems are required to perform audio signal processing, in order to obtain different output signals. Technology implementation is relatively complex, and therefore, designing an audio signal processing apparatus to meet requirements in multiple application scenarios, such as high definition voice communication, an audio and video conference, voice interaction, and spatial sound field recording at the same time is a research direction of the microphone array processing technology.

SUMMARY

Embodiments of the present disclosure provide an audio signal processing method and apparatus and a differential beamforming method and apparatus, in order to resolve a problem that an existing audio signal processing apparatus cannot meet requirements for audio signal processing in multiple application scenarios at the same time.

According to a first aspect, an audio signal processing apparatus is provided, where the apparatus includes a weighting coefficient storage module, a signal acquiring module, a beamforming processing module, and a signal output module, where the weighting coefficient storage module is configured to store a super-directional differential beamforming weighting coefficient. The signal acquiring module is configured to acquire an audio input signal and output the audio input signal to the beamforming processing module, and is further configured to determine a current application scenario and an output signal type required by the current application scenario, and transmit the current application scenario and the output signal type required by the current application scenario to the beamforming processing module. The beamforming processing module is configured to acquire, according to the output signal type required by the current application scenario, a weighting coefficient corresponding to the current application scenario from the weighting coefficient storage module, perform super-directional differential beamforming processing on the audio input signal using the acquired weighting coefficient, in order to obtain a super-directional differential beamforming signal, and transmit the super-directional differential beamforming signal to the signal output module. The signal output module is configured to output the super-directional differential beamforming signal.

With reference to the first aspect, in a first possible implementation manner, the beamforming processing module is further configured to, when the output signal type required by the current application scenario is a dual-channel signal, acquire an audio-left channel super-directional differential beamforming weighting coefficient and an audio-right channel super-directional differential beamforming weighting coefficient from the weighting coefficient storage module, perform super-directional differential beamforming processing on the audio input signal according to the audio-left channel super-directional differential beamforming weighting coefficient, in order to obtain an audio-left channel super-directional differential beamforming signal, perform super-directional differential beamforming processing on the audio input signal according to the audio-right channel super-directional differential beamforming weighting coefficient, in order to obtain an audio-right channel super-directional differential beamforming signal, and transmit the audio-left channel super-directional differential beamforming signal and the audio-right channel super-directional differential beamforming signal to the signal output module. The signal output module is further configured to output the audio-left channel super-directional differential beamforming signal and the audio-right channel super-directional differential beamforming signal.

With reference to the first aspect, in a second possible implementation manner, the beamforming processing module is further configured to, when the output signal type required by the current application scenario is a mono signal, acquire a mono super-directional differential beamforming weighting coefficient corresponding to the current application scenario from the weighting coefficient storage module, perform super-directional differential beamforming processing on the audio input signal according to the mono super-directional differential beamforming weighting coefficient, in order to form one mono super-directional differential beamforming signal, and transmit the one mono super-directional differential beamforming signal to the signal output module. The signal output module is further configured to output the one mono super-directional differential beamforming signal.

With reference to the first aspect, in a third possible implementation manner, the audio signal processing apparatus further includes a microphone array adjustment module, where the microphone array adjustment module is configured to adjust a microphone array to form a first subarray and a second subarray, where an end-fire direction of the first subarray is different from an end-fire direction of the second subarray, and the first subarray and the second subarray each collect an original audio signal, and transmit the original audio signal to the signal acquiring module as the audio input signal.

With reference to the first aspect, in a fourth possible implementation manner, the audio signal processing apparatus further includes a microphone array adjustment module, where the microphone array adjustment module is configured to adjust an end-fire direction of a microphone array, such that the end-fire direction points to a target sound source, and the microphone array collects an original audio signal emitted from the target sound source, and transmits the original audio signal to the signal acquiring module as the audio input signal.

With reference to the first aspect, the first possible implementation manner of the first aspect, and the second possible implementation manner of the first aspect, in a fifth possible implementation manner, the audio signal processing apparatus further includes a weighting coefficient updating module, where the weighting coefficient updating module is configured to determine whether an audio collection area is adjusted, if the audio collection area is adjusted, determine a geometric shape of a microphone array, a position of a loudspeaker, and an adjusted audio collection effective area, adjust a beam shape according to the audio collection effective area, or adjust a beam shape according to the audio collection effective area and the position of the loudspeaker, in order to obtain an adjusted beam shape, and determine the super-directional differential beamforming weighting coefficient according to the geometric shape of the microphone array and the adjusted beam shape, in order to obtain an adjusted weighting coefficient, and transmit the adjusted weighting coefficient to the weighting coefficient storage module. The weighting coefficient storage module is further configured to store the adjusted weighting coefficient.

With reference to the first aspect, in a sixth possible implementation manner, the audio signal processing apparatus further includes an echo cancellation module, where the echo cancellation module is configured to temporarily store a signal played by a loudspeaker, perform echo cancellation on an original audio signal collected by a microphone array, in order to obtain an echo-canceled audio signal, and transmit the echo-canceled audio signal to the signal acquiring module as the audio input signal, or perform echo cancellation on the super-directional differential beamforming signal output by the beamforming processing module, in order to obtain an echo-canceled super-directional differential beamforming signal, and transmit the echo-canceled super-directional differential beamforming signal to the signal output module. The signal output module is further configured to output the echo-canceled super-directional differential beamforming signal.

With reference to the first aspect, in a seventh possible implementation manner, the audio signal processing apparatus further includes an echo suppression module and a noise suppression module, where the echo suppression module is configured to perform echo suppression processing on the super-directional differential beamforming signal output by the beamforming processing module or perform echo suppression processing on a noise-suppressed super-directional differential beamforming signal output by the noise suppression module, in order to obtain an echo-suppressed super-directional differential beamforming signal, and transmit the echo-suppressed super-directional differential beamforming signal to the signal output module. The noise suppression module is configured to perform noise suppression processing on the super-directional differential beamforming signal output by the beamforming processing module or perform noise suppression processing on the echo-suppressed super-directional differential beamforming signal output by the echo suppression module, in order to obtain the noise-suppressed super-directional differential beamforming signal, and transmit the noise-suppressed super-directional differential beamforming signal to the signal output module. The signal output module is further configured to output the echo-suppressed super-directional differential beamforming signal or the noise-suppressed super-directional differential beamforming signal.

With reference to the seventh possible implementation manner of the first aspect, in an eighth possible implementation manner, the beamforming processing module is further configured to form, in another direction, except a direction of a sound source, in adjustable end-fire directions of a microphone array, at least one beamforming signal as a reference noise signal, and transmit the reference noise signal to the noise suppression module.

According to a second aspect, an audio signal processing method is provided, where the method includes determining a super-directional differential beamforming weighting coefficient, acquiring an audio input signal and determining a current application scenario and an output signal type required by the current application scenario, acquiring, according to the output signal type required by the current application scenario, a weighting coefficient corresponding to the current application scenario, performing super-directional differential beamforming processing on the audio input signal using the acquired weighting coefficient, in order to obtain a super-directional differential beamforming signal, and outputting the super-directional differential beamforming signal.

With reference to the second aspect, in a first possible implementation manner, the acquiring, according to the output signal type required by the current application scenario, a weighting coefficient corresponding to the current application scenario, performing super-directional differential beamforming processing on the audio input signal using the acquired weighting coefficient, in order to obtain a super-directional differential beamforming signal, and outputting the super-directional differential beamforming signal further includes, when the output signal type required by the current application scenario is a dual-channel signal, acquiring an audio-left channel super-directional differential beamforming weighting coefficient and an audio-right channel super-directional differential beamforming weighting coefficient, performing super-directional differential beamforming processing on the audio input signal according to the audio-left channel super-directional differential beamforming weighting coefficient, in order to obtain an audio-left channel super-directional differential beamforming signal, performing super-directional differential beamforming processing on the audio input signal according to the audio-right channel super-directional differential beamforming weighting coefficient, in order to obtain an audio-right channel super-directional differential beamforming signal, and outputting the audio-left channel super-directional differential beamforming signal and the audio-right channel super-directional differential beamforming signal.

With reference to the second aspect, in a second possible implementation manner, the acquiring, according to the output signal type required by the current application scenario, a weighting coefficient corresponding to the current application scenario, performing super-directional differential beamforming processing on the audio input signal using the acquired weighting coefficient, in order to obtain a super-directional differential beamforming signal, and outputting the super-directional differential beamforming signal further includes, when the output signal type required by the current application scenario is a mono signal, acquiring a mono super-directional differential beamforming weighting coefficient for forming the mono signal in the current application scenario, performing super-directional differential beamforming processing on the audio input signal according to the acquired mono super-directional differential beamforming weighting coefficient, in order to form one mono super-directional differential beamforming signal, and outputting the one mono super-directional differential beamforming signal.

With reference to the second aspect, in a third possible implementation manner, before the acquiring an audio input signal, the method further includes adjusting a microphone array to form a first subarray and a second subarray, where an end-fire direction of the first subarray is different from an end-fire direction of the second subarray, collecting an original audio signal using each of the first subarray and the second subarray, and using the original audio signal as the audio input signal.

With reference to the second aspect, in a fourth possible implementation manner, before the acquiring an audio input signal, the method further includes adjusting an end-fire direction of a microphone array, such that the end-fire direction points to a target sound source, collecting an original audio signal of the target sound source, and using the original audio signal as the audio input signal.

With reference to the second aspect, the first possible implementation manner of the second aspect, and the second possible implementation manner of the second aspect, in a fifth possible implementation manner, before the acquiring, according to the output signal type required by the current application scenario, a weighting coefficient corresponding to the current application scenario, the method further includes determining whether an audio collection area is adjusted, if the audio collection area is adjusted, determining a geometric shape of a microphone array, a position of a loudspeaker, and an adjusted audio collection effective area, adjusting a beam shape according to the audio collection effective area, or adjusting a beam shape according to the audio collection effective area and the position of the loudspeaker, in order to obtain an adjusted beam shape; determining the super-directional differential beamforming weighting coefficient according to the geometric shape of the microphone array and the adjusted beam shape, in order to obtain an adjusted weighting coefficient, and performing super-directional differential beamforming processing on the audio input signal using the adjusted weighting coefficient.

With reference to the second aspect, in a sixth possible implementation manner, the method further includes performing echo cancellation on an original audio signal collected by a microphone array, or performing echo cancellation on the super-directional differential beamforming signal.

With reference to the second aspect, in a seventh possible implementation manner, after the super-directional differential beamforming signal is formed, the method further includes performing echo suppression processing and/or noise suppression processing on the super-directional differential beamforming signal.

With reference to the second aspect, in an eighth possible implementation manner, the method further includes forming, in another direction, except a direction of a sound source, in adjustable end-fire directions of a microphone array, at least one beamforming signal as a reference noise signal, and performing noise suppression processing on the super-directional differential beamforming signal using the reference noise signal.

According to a third aspect, a differential beamforming method is provided, where the method includes determining, according to a geometric shape of a microphone array and a set audio collection effective area, a differential beamforming weighting coefficient and storing the differential beamforming weighting coefficient, or determining, according to a geometric shape of a microphone array, a set audio collection effective area, and a position of a loudspeaker, a differential beamforming weighting coefficient and storing the differential beamforming weighting coefficient, acquiring, according to an output signal type required by a current application scenario, a weighting coefficient corresponding to the current application scenario, and performing differential beamforming processing on an audio input signal using the acquired weighting coefficient, in order to obtain a super-directional differential beam.

With reference to the third aspect, in a first possible implementation manner, a process of the determining a differential beamforming weighting coefficient further includes: determining $D(\omega,\theta)$ and $\beta$ according to the geometric shape of the microphone array and the set audio collection effective area, or determining $D(\omega,\theta)$ and $\beta$ according to the geometric shape of the microphone array, the set audio collection effective area, and the position of the loudspeaker, and determining a super-directional differential beamforming weighting coefficient according to the determined $D(\omega,\theta)$ and $\beta$ using a formula $h(\omega)=D^H(\omega,\theta)[D(\omega,\theta)D^H(\omega,\theta)]^{-1}\beta$, where $h(\omega)$ represents a weighting coefficient, $D(\omega,\theta)$ represents a steering matrix corresponding to a microphone array in any geometric shape, where the steering matrix is determined according to a relative delay generated when a sound source arrives at each microphone in the microphone array from different incident angles, $D^H(\omega,\theta)$ represents a conjugate transpose matrix of $D(\omega,\theta)$, $\omega$ represents a frequency of an audio signal, $\theta$ represents an incident angle of the sound source, and $\beta$ represents a response vector when the incident angle is $\theta$.

With reference to the first possible implementation manner of the third aspect, in a second possible implementation manner, the determining $D(\omega,\theta)$ and $\beta$ according to the geometric shape of the microphone array and the set audio collection effective area further includes converting the set audio effective area into a pole direction and a null direction according to output signal types required by different application scenarios, and determining $D(\omega,\theta)$ and $\beta$ in different application scenarios according to the pole direction and the null direction that are obtained after the conversion, where the pole direction is an incident angle that enables a response value of the super-directional differential beam in this direction to be 1, and the null direction is an incident angle that enables a response value of the super-directional differential beam in this direction to be 0.

With reference to the first possible implementation manner of the third aspect, in a third possible implementation manner, the determining $D(\omega,\theta)$ and $\beta$ according to the geometric shape of the microphone array, the set audio collection effective area, and the position of the loudspeaker further includes, according to output signal types required by different application scenarios, converting the set audio effective area into a pole direction and a null direction and converting the position of the loudspeaker into a null direction, and determining $D(\omega,\theta)$ and $\beta$ in different application scenarios according to the pole direction and the null directions that are obtained after the conversion, where the pole direction is an incident angle that enables a response value of the super-directional differential beam in this direction to be 1, and the null direction is an incident angle that enables a response value of the super-directional differential beam in this direction to be 0.

With reference to the second possible implementation manner of the third aspect, or with reference to the third possible implementation manner of the third aspect, in a fourth possible implementation manner, the converting the set audio effective area into a pole direction and a null direction according to output signal types required by different application scenarios further includes, when an output signal type required by an application scenario is a mono signal, setting an end-fire direction of the microphone array as the pole direction, and setting M null directions, where $M \leq N-1$, and N represents a quantity of microphones in the microphone array, or when an output signal type required by an application scenario is a dual-channel signal, setting a 0-degree direction of the microphone array as the pole direction, and setting a 180-degree direction of the microphone array as the null direction, in order to determine a super-directional differential beamforming weighting coefficient corresponding to one channel in dual channels, and setting the 180-degree direction of the microphone array as the pole direction, and setting the 0-degree direction of the microphone array as the null direction, in order to determine a super-directional differential beamforming weighting coefficient corresponding to the other channel.

According to a fourth aspect, a differential beamforming apparatus is provided, where the apparatus includes a weighting coefficient determining unit and a beamforming processing unit, where the weighting coefficient determining unit is configured to determine a differential beamforming weighting coefficient according to a geometric shape of a microphone array and a set audio collection effective area, and transmit the formed weighting coefficient to the beamforming processing unit, or determine a differential beamforming weighting coefficient according to a geometric shape of a microphone array, a set audio collection effective area, and a position of a loudspeaker, and transmit the formed weighting coefficient to the beamforming processing unit, and the beamforming processing unit acquires, according to an output signal type required by a current application scenario, a weighting coefficient corresponding to the current application scenario from the weighting coefficient determining unit, and performs differential beamforming processing on an audio input signal using the acquired weighting coefficient.

With reference to the fourth aspect, in a first possible implementation manner, the weighting coefficient determining unit is further configured to determine $D(\omega,\theta)$ and $\beta$ according to the geometric shape of the microphone array and the set audio collection effective area, or determine $D(\omega,\theta)$ and $\beta$ according to the geometric shape of the microphone array, the set audio collection effective area, and the position of the loudspeaker, and determine a super-directional differential beamforming weighting coefficient according to the determined $D(\omega,\theta)$ and $\beta$ using a formula $h(\omega)=D^H(\omega,\theta)[D(\omega,\theta)D^H(\omega,\theta)]^{-1}\beta$, where $h(\omega)$ represents a weighting coefficient, $D(\omega,\theta)$ represents a steering matrix corresponding to a microphone array in any geometric shape, where the steering matrix is determined according to a relative delay generated when a sound source arrives at each microphone in the microphone array from different incident angles, $D^H(\omega,\theta)$ represents a conjugate transpose matrix of $D(\omega,\theta)$, $\omega$ represents a frequency of an audio signal, $\theta$ represents an incident angle of the sound source, and $\beta$ represents a response vector when the incident angle is $\theta$.

With reference to the first possible implementation manner of the fourth aspect, in a second possible implementation manner, the weighting coefficient determining unit is further configured to convert the set audio effective area into a pole direction and a null direction according to output signal types required by different application scenarios, and determine $D(\omega,\theta)$ and $\beta$ in different application scenarios according to the obtained pole direction and the obtained null direction, or according to output signal types required by different application scenarios, convert the set audio effective area into a pole direction and a null direction and convert the position of the loudspeaker into a null direction, and determine $D(\omega,\theta)$ and $\beta$ in different application scenarios according to the obtained pole direction and the obtained null directions, where the pole direction is an incident angle that enables a response value of a super-directional differential beam in this direction to be 1, and the null direction is an incident angle that enables a response value of a super-directional differential beam in this direction to be 0.

With reference to the second possible implementation manner of the fourth aspect, in a third possible implementation manner, the weighting coefficient determining unit is further configured to, when an output signal type required by an application scenario is a mono signal, set an end-fire direction of the microphone array as the pole direction, and set M null directions, where $M \leq N-1$, and N represents a quantity of microphones in the microphone array, or when an output signal type required by an application scenario is a dual-channel signal, set a 0-degree direction of the microphone array as the pole direction, and set a 180-degree direction of the microphone array as the null direction, in order to determine a super-directional differential beamforming weighting coefficient corresponding to one channel in dual channels, and set the 180-degree direction of the microphone array as the pole direction, and set the 0-degree direction of the microphone array as the null direction, in order to determine a super-directional differential beamforming weighting coefficient corresponding to the other channel.

According to the audio signal processing apparatus provided in the present disclosure, a beamforming processing module acquires, according to an output signal type required by a current application scenario, a weighting coefficient corresponding to the current application scenario from a weighting coefficient storage module, performs, using the acquired weighting coefficient, super-directional differential beamforming processing on an audio input signal output by a signal acquiring module, in order to form a super-directional differential beamforming signal in the current application scenario, and performs corresponding processing on the super-directional differential beamforming signal to obtain a final required audio output signal. In this way, a requirement that different application scenarios require different audio signal processing manners can be met.

DESCRIPTION OF EMBODIMENTS

The following clearly describes the technical solutions in the embodiments of the present disclosure with reference to the accompanying drawings in the embodiments of the present disclosure. The described embodiments are merely some but not all of the embodiments of the present disclosure. All other embodiments obtained by persons of ordinary skill in the art based on the embodiments of the present disclosure without creative efforts shall fall within the protection scope of the present disclosure.

Embodiment 1

Figure 1:
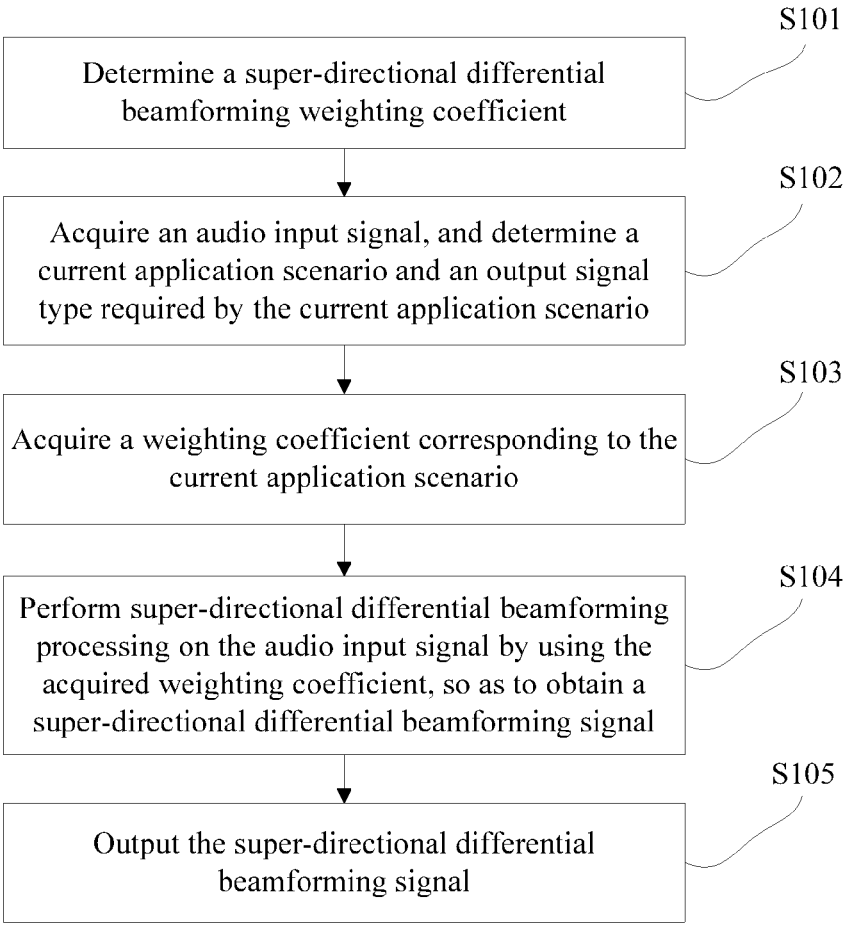
FIG. 1 is a flowchart of an audio signal processing method according to an embodiment of the present disclosure.

Embodiment 1 of the present disclosure provides an audio signal processing method. As shown in FIG. 1, the method includes the following steps.

Step S101: Determine a super-directional differential beamforming weighting coefficient.

Application scenarios according to this embodiment of the present disclosure may include multiple application scenarios, such as a high definition call, an audio and video conference, voice interaction, and spatial sound field recording, and different super-directional differential beamforming weighting coefficients may be determined according to audio signal processing manners required by different application scenarios. In this embodiment of the present disclosure, a super-directional differential beam is a differential beam that is constructed according to a geometric shape of a microphone array and a preset beam shape.

Step S102: Acquire an audio input signal required by a current application scenario, and determine the current application scenario and an output signal type required by the current application scenario.

In this embodiment of the present disclosure, when the super-directional differential beam is to be formed, different audio input signals may be determined according to whether echo cancellation processing needs to be performed, in the current application scenario, on an original audio signal collected by the microphone array. The audio input signal may be an audio signal obtained after echo cancellation is performed on the original audio signal collected by the microphone array, or the original audio signal collected by the microphone array, which is determined according to the current application scenario.

Output signal types required by different application scenarios are different. For example, a mono signal is required by application scenarios of human computer interaction and high definition voice communication, and a dual-channel signal is required by application scenarios of spatial sound field recording and a stereo call. In this embodiment of the present disclosure, the output signal type required by the current application scenario is determined according to the determined current application scenario.

Step S103: Acquire a weighting coefficient corresponding to the current application scenario.

Furthermore, in this embodiment of the present disclosure, the corresponding weighting coefficient is acquired according to the output signal type required by the current application scenario. When the output signal type required by the current application scenario is a dual-channel signal, an audio-left channel super-directional differential beamforming weighting coefficient corresponding to the current application scenario and an audio-right channel super-directional differential beamforming weighting coefficient corresponding to the current application scenario are acquired, or when the output signal type required by the current application scenario is a mono signal, a mono super-directional differential beamforming weighting coefficient that is of the current application scenario and is used for forming the mono signal is acquired.

Step S104: Perform, using the weighting coefficient acquired in step S103, super-directional differential beamforming processing on the audio input signal acquired in step S102, in order to obtain a super-directional differential beamforming signal.

Furthermore, in this embodiment of the present disclosure, when the output signal type required by the current application scenario is a dual-channel signal, the audio-left channel super-directional differential beamforming weighting coefficient corresponding to the current application scenario and the audio-right channel super-directional differential beamforming weighting coefficient corresponding to the current application scenario are acquired, super-directional differential beamforming processing is performed on the audio input signal according to the audio-left channel super-directional differential beamforming weighting coefficient corresponding to the current application scenario, in order to obtain an audio-left channel super-directional differential beamforming signal corresponding to the current application scenario, and super-directional differential beamforming processing is performed on the audio input signal according to the audio-right channel super-directional differential beamforming weighting coefficient corresponding to the current application scenario, in order to obtain an audio-right channel super-directional differential beamforming signal corresponding to the current application scenario.

In this embodiment of the present disclosure, when the output signal type required by the current application scenario is a mono signal, a super-directional differential beamforming weighting coefficient that corresponds to the current application scenario and is used for forming the mono signal is acquired, and super-directional differential beamforming processing is performed on the audio input signal according to the acquired super-directional differential beamforming weighting coefficient, in order to form one mono super-directional differential beamforming signal.

Step S105: Output the super-directional differential beamforming signal obtained in step S104.

Furthermore, in this embodiment of the present disclosure, after the super-directional differential beamforming signal obtained in step S104 is output, processing may be performed on the super-directional differential beamforming signal, in order to obtain a final audio signal required by the current application scenario. That is, processing may be performed on the super-directional differential beamforming signal according to a signal processing manner required by the current application scenario, for example, noise suppression processing and echo suppression processing are performed on the super-directional differential beamforming signal, in order to finally obtain an audio signal required by the current application scenario.

According to this embodiment of the present disclosure, super-directional differential beamforming weighting coefficients in different application scenarios are predetermined. When audio signals need to be processed in different application scenarios, a determined super-directional differential beamforming weighting coefficient in a current application scenario and an audio input signal in the current application scenario may be used to form a super-directional differential beamforming signal in the current application scenario, and corresponding processing is performed on the super-directional differential beamforming signal to obtain a final required audio signal. In this way, a requirement that different application scenarios require different audio signal processing manners can be met.

Embodiment 2

The following describes the audio signal processing method according to Embodiment 1 in detail with reference to the accompanying drawings in the present disclosure.

1. Determine a Super-Directional Differential Beamforming Weighting Coefficient.

In this embodiment of the present disclosure, super-directional differential beamforming weighting coefficients corresponding to different output signal types in different application scenarios may be determined according to a geometric shape of a microphone array and a set beam shape, where the beam shape is determined according to requirements imposed by different output signal types on the beam shape in different application scenarios, or determined according to requirements imposed by different output signal types on the beam shape in different application scenarios and a position of a loudspeaker.

In this embodiment of the present disclosure, when the super-directional differential beamforming weighting coefficient is to be determined, a microphone array that is used to collect an audio signal needs to be construct. A relative delay generated when a sound source arrives at each microphone in the microphone array from different incident angles is obtained according to a geometric shape of the microphone array, and the super-directional differential beamforming weighting coefficient is determined according to a set beam shape.

Super-directional differential beamforming weighting coefficients corresponding to different output signal types in different application scenarios are determined according to a geometric shape of an omnidirectional microphone array and a set beam shape, which may be calculated using the following formula:

$$h(\omega)=D^H(\omega,\theta)[D(\omega,\theta)D^H(\omega,\theta)]^{-1}\beta,$$

where $h(\omega)$ represents a weighting coefficient, $D(\omega,\theta)$ represents a steering matrix corresponding to a microphone array in any geometric shape, where the steering matrix is determined according to a relative delay generated when a sound source arrives at each microphone in the microphone array from different incident angles, $D^H(\omega,\theta)$ represents a conjugate transpose matrix of $D(\omega,\theta)$, $\omega$ represents a frequency of an audio signal, $\theta$ represents an incident angle of the sound source, and $\beta$ represents a response vector when the incident angle is $\theta$.

In a specific application, discretization processing is generally performed on the frequency $\omega$, that is, some frequency bins are discretely sampled in an effective frequency band of a signal. For different frequencies $\omega_k$, corresponding weighting coefficients $h(\omega_k)$ are separately calculated to form a coefficient matrix. A value range of k is related to a quantity of effective frequency bins used for super-directional differential beamforming. It is assumed that a length for fast discrete Fourier transform used for super-directional differential beamforming is FFT_LEN, and the quantity of effective frequency bins is FFT_LEN/2+1. It is assumed that a sampling rate of the signal is A Hertz (Hz). Then, $$\omega_k = \frac{2\pi A}{\text{FFT_LEN}}k,\ k = 0, 1 \ldots, \text{FFT_LEN}/2.$$

In this embodiment of the present disclosure, a geometric shape of a constructed microphone array may be flexibly set, and a specific geometric shape of the constructed microphone array is not limited. As long as a relative delay generated when a sound source arrives at each microphone in the microphone array from different incident angles can be obtained and $D(\omega,\theta)$ is determined, a weighting coefficient can be determined according to a set beam shape using the foregoing formula.

Furthermore, in this embodiment of the present disclosure, different weighting coefficients need to be determined according to output signal types required by different application scenarios, when an output signal required by an application scenario is a dual-channel signal, an audio-left channel super-directional differential beamforming weighting coefficient and an audio-right channel super-directional differential beamforming weighting coefficient need to be determined using the foregoing formula. When an output signal required by an application scenario is a mono signal, a mono super-directional differential beamforming weighting coefficient for forming the mono signal needs to be determined using the foregoing formula.

Further, in this embodiment of the present disclosure, before a corresponding weighting coefficient is determined, the method further includes determining whether an audio collection area is adjusted; if the audio collection area is adjusted, determining a geometric shape of a microphone array, a position of a loudspeaker, and an adjusted audio collection effective area, adjusting a beam shape according to the adjusted audio collection effective area, or adjusting a beam shape according to the adjusted audio collection effective area and the position of the loudspeaker, in order to obtain an adjusted beam shape, and determining the super-directional differential beamforming weighting coefficient according to the geometric shape of the microphone array and the adjusted beam shape using a formula $h(\omega)=D^H(\omega,\theta)[D(\omega,\theta)D^H(\omega,\theta)]^{-1}\beta$, in order to obtain an adjusted weighting coefficient and perform super-directional differential beamforming processing on an audio input signal using the adjusted weighting coefficient.

In this embodiment of the present disclosure, different values of $D(\omega,\theta)$ may be obtained according to different geometric shapes of constructed microphone arrays, which is described in the following using an example.

In the present disclosure, a linear array including N microphones may be constructed. In this embodiment of the present disclosure, microphones and loudspeakers in the linear microphone array may be arranged in many manners. In this embodiment of the present disclosure, to implement adjustment of an end-fire direction of a microphone, the microphone is disposed on a rotatable platform. As shown in FIG. 2A to FIG. 2F, loudspeakers are disposed on two sides, and a part between the two loudspeakers is divided into two layers, where the upper layer is rotatable, and N microphones are disposed at the upper layer, where N is a positive integer that is greater than or equal to 2, and the N microphones may be disposed in a linear form at equal intervals, or may be disposed in a linear form at unequal intervals.

Figure 2A:
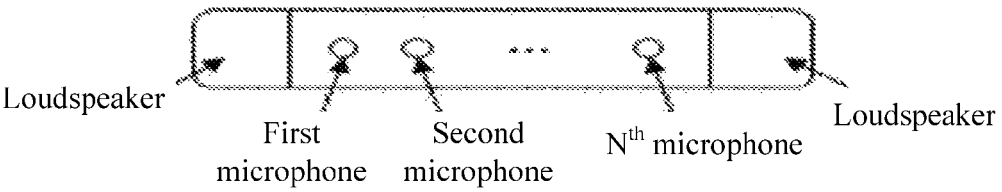
FIG. 2A to FIG. 2F are schematic diagrams of arrangement of microphones in a linear form according to an embodiment of the present disclosure.
Figure 2B:
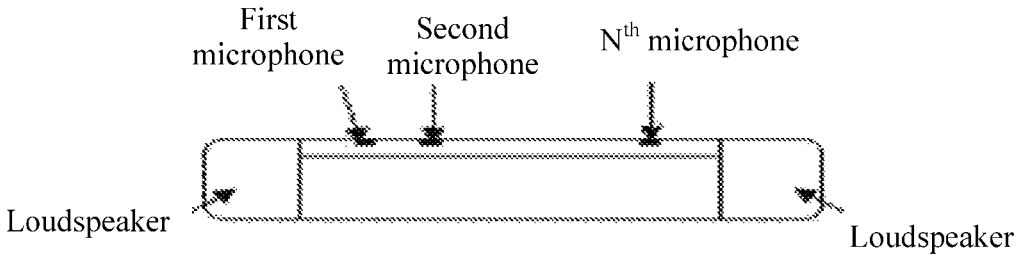

FIG. 2A and FIG. 2B are schematic diagrams of a first manner for arranging microphones and loudspeakers, where holes of the microphones are disposed on the top. FIG. 2A is a top view of arrangement of the microphones and the loudspeakers, and FIG. 2B is a front side view of arrangement of the microphones and the loudspeakers.

Figure 2C:
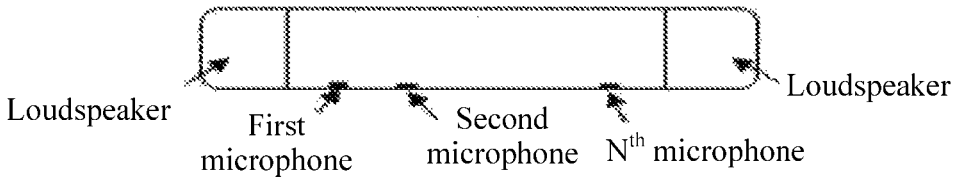
Figure 2D:
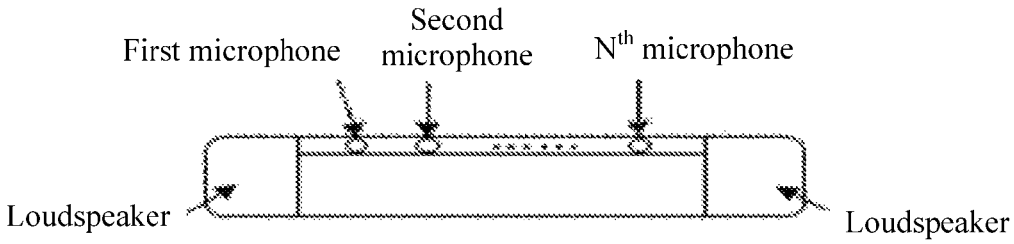

FIG. 2C and FIG. 2D are a top view and a front side view of another manner for arranging microphones and loudspeakers according to the present disclosure. Compared with FIG. 2A and FIG. 2B, a difference lies in that holes of the microphones are disposed on the front side.

Figure 2E:
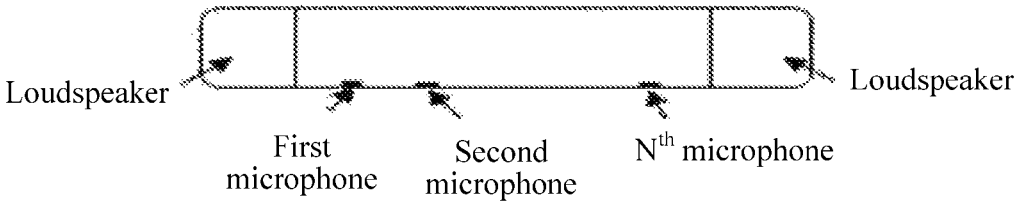
Figure 2F:
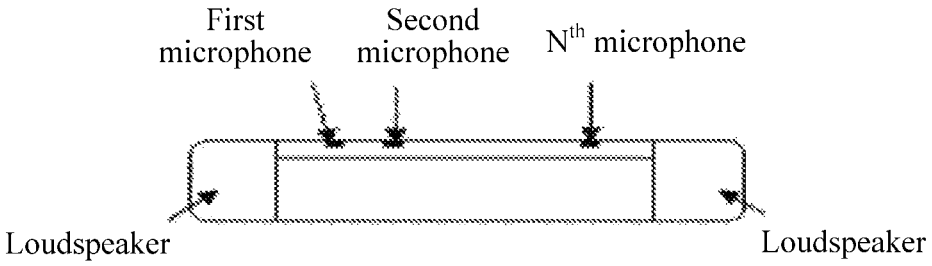

FIG. 2E and FIG. 2F are a top view and a front side view of a third manner for arranging microphones and loudspeakers according to the present disclosure. Compared with the foregoing two manners, a difference lies in that holes of the microphones are disposed on a side boundary of an upper layer part.

In this embodiment of the present disclosure, in addition to the linear array, the microphone array may be a microphone array in any other geometric shape, such as a circular array, a triangular array, a rectangular array, or another polygon array. Certainly, only an exemplary description is given herein, arrangement positions of microphones and loudspeakers in this embodiment of the present disclosure are not limited to the foregoing several cases.

Figure 3A:
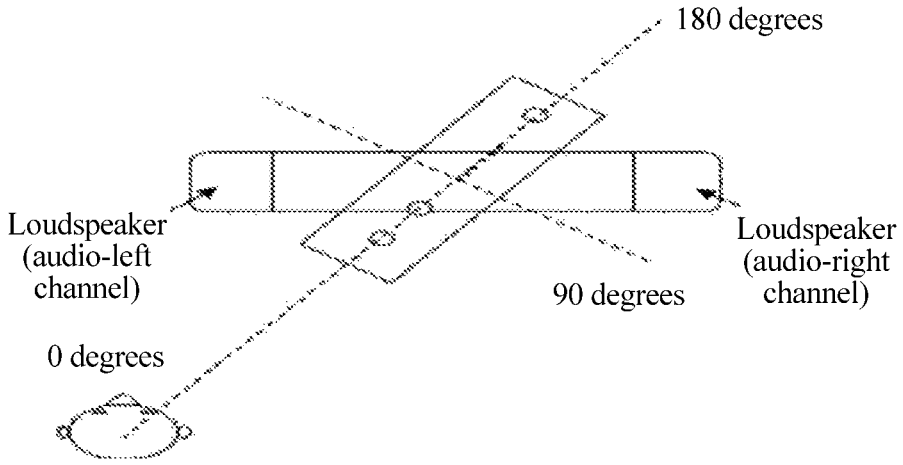
FIG. 3A to FIG. 3C are schematic diagrams of microphone arrays according to an embodiment of the present disclosure.

In this embodiment of the present disclosure, $D(\omega,\theta)$ may be determined in different manners according to different geometric shapes of constructed microphone arrays. For example:

In this embodiment of the present disclosure, when the microphone array is a linear array including N microphones, as shown in FIG. 3A, $D(\omega,\theta)$ and $\beta$ may be determined using the following formula:

$$D(\omega,\theta)=\begin{bmatrix} d^H(\omega,\cos\theta_1) \\ d^H(\omega,\cos\theta_2) \\ \vdots \\ d^H(\omega,\cos\theta_M) \end{bmatrix},$$

where $d^H(\omega,\cos\theta_i)=[e^{-j\omega\tau_1\cos\theta_i}\ e^{-j\omega\tau_2\cos\theta_i}\ldots e^{-j\omega\tau_N\cos\theta_i}]^T$, $i=1,2,\ldots,M$, and $$\tau_k=\frac{d_k}{c},$$

$k=1,2,\ldots,N$, where $\theta_i$ represents an $i^{th}$ set incident angle of a sound source, a superscript T represents transpose, c represents a sound velocity and generally may be 342 meter per second (m/s) or 340 m/s, $d_k$ represents a distance between a $k^{th}$ microphone and a set origin position of the array, and generally, the origin position of the microphone array is a geometric center of the array, or a position of a microphone (for example, the first microphone) in the array may be used as the origin, $\omega$ represents a frequency of an audio signal, N represents a quantity of microphones in the microphone array, and M represents a quantity of set incident angles of the sound source, where $M\leq N$.

A formula for calculating a response vector $\beta$ is as follows:

$$\beta=[\beta_1\beta_2\ldots\beta_M]^T,$$

where $\beta_i$, $i=1,2,\ldots,M$ is a response value corresponding to the $i^{th}$ set incident angle of the sound source.

Figure 3B:
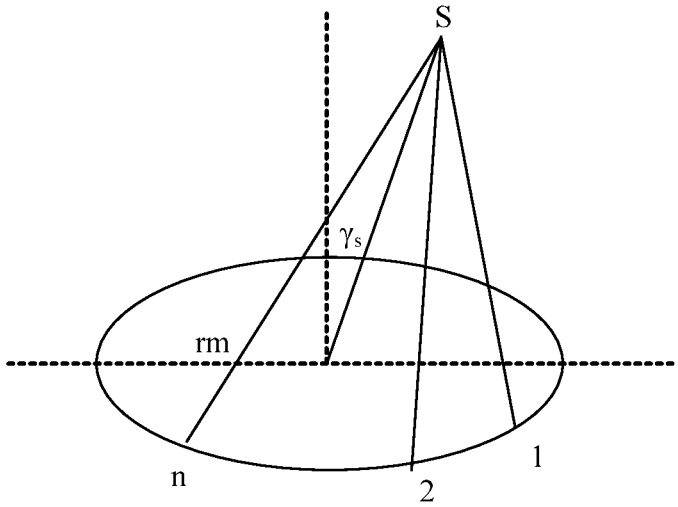

When the microphone array is an uniform circular array including N microphones, as shown in FIG. 3B, it is assumed that b represents a radius of the uniform circular array, $\theta$ represents an incident angle of a sound source, $r_s$ represents a distance between the sound source and a center position of the microphone array, f represents a sampling frequency at which the microphone array collects a signal, and c represents a sound velocity, and it is assumed that a position of an interested sound source is S, a projection of the position S on a platform on which the uniform circular array is located is S', and an angle between S' and the first microphone is called a horizontal angle and is marked as $\alpha_1$. A horizontal angle of an $n^{th}$ microphone is $\alpha_n$, and $$\alpha_n=\alpha_1+\frac{2\pi(n-1)}{N},\ n=1,2,\ldots,N.$$

A distance between the sound source S and the $n^{th}$ microphone in the microphone array is $r_n$, and $$r_n=\sqrt{|Ss'|^2+|ns'|^2}=\sqrt{r_s^2+b^2-2br_s\sin\theta\cos\alpha_n},\ n=1,2,\ldots,N.$$

A delay adjustment parameter is as follows:

$$T = [T_1, T_2, \ldots, T_N] = \left[\frac{r_1 - r_s}{c} f, \frac{r_2 - r_s}{c} f, \ldots \frac{r_N - r_s}{c} f,\right].$$

A formula for calculating a weighting coefficient using a method for designing a super-directional differential beamforming weighting coefficient is as follows:

$$h(\omega)=D^H(\omega,\theta)[D(\omega,\theta)D^H(\omega,\theta)]^{-1}\beta.$$

A formula for calculating a steering matrix D(ω,θ) is as follows:

$$D(\omega, \theta) = \begin{bmatrix} d^H(\omega, \theta_1) \\ d^H(\omega, \theta_2) \\ \vdots \\ d^H(\omega, \theta_M) \end{bmatrix},$$

where $$d^H(\omega, \theta_i) = \left[e^{-j\omega\frac{r_1-r_s}{c}} e^{-j\omega\frac{r_2-r_s}{c}} \ldots e^{-j\omega\frac{r_N-r_s}{c}}\right]^T,$$

i=1, 2, . . . , M.

A formula for calculating a response matrix β is as follows:

$$\beta=[\beta_1\beta_2 \ldots \beta_M]^T.$$

b represents a radius of the uniform circular array, $\theta_i$ represents an $i^{th}$ set incident angle of a sound source, $r_s$ represents a distance between the sound source and a center position of the microphone array, $\alpha_1$ represents an angle between a projection of a set position of the sound source on a platform on which the uniform circular array is located and the first microphone, c represents a sound velocity, corepresents a frequency of an audio signal, a superscript T represents transpose, N represents a quantity of microphones in the microphone array, M represents a quantity of set incident angles of the sound source, and $\beta_i$, i=1, 2, . . . , M represents a response value corresponding to the $i^{th}$ set incident angle of the sound source.

Figure 3C:
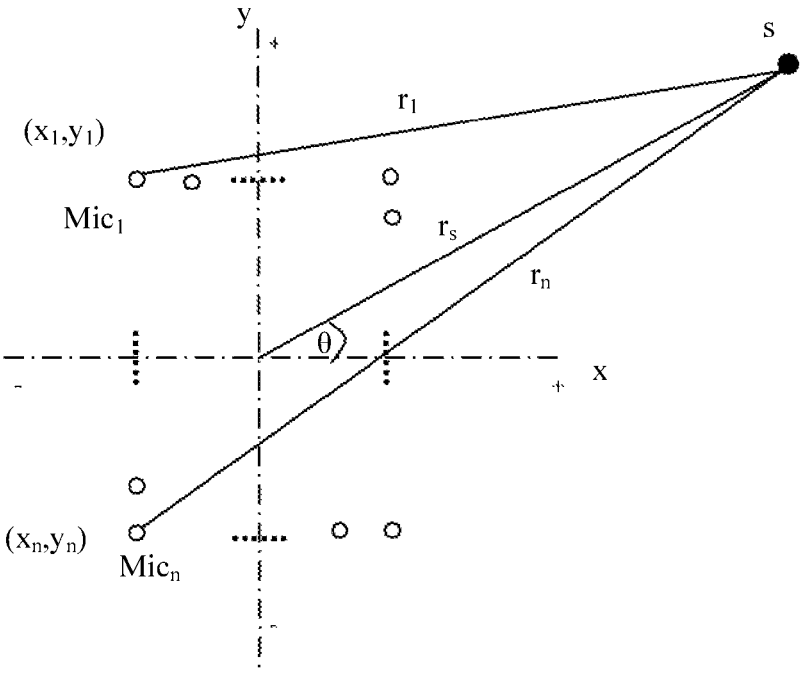

When the microphone array is an uniform rectangular array including N microphones, as shown in FIG. 3C, a geometric center of the rectangular array is used as an origin, and it is assumed that coordinates of an $n^{th}$ microphone in the microphone array are $(x_n, y_n)$, a set incident angle of a sound source is θ, and a distance between the sound source and a center position of the microphone array is $r_s$.

A distance between the sound source S and an $n^{th}$ array element ($Mic_n$) in the microphone array is $r_n$, and $$r_n=\sqrt{(r_s\cos\theta-x_n)^2+(r_s\sin\theta-y_n)^2},\ n=1,2, \ldots ,N.$$

A delay adjustment parameter is as follows:

$$T = [T_1, T_2, \ldots, T_N] = \left[\frac{r_1 - r_s}{c} f, \frac{r_2 - r_s}{c} f, \ldots \frac{r_N - r_s}{c} f,\right].$$

A formula for calculating a weighting coefficient using a method for designing a super-directional differential beamforming weighting coefficient is as follows:

$$h(\omega)=D^H(\omega,\theta)[D(\omega,\theta)D^H(\omega,\theta)]^{-1}\beta.$$

A formula for calculating a steering matrix D(ω,θ) is as follows:

$$D(\omega, \theta) = \begin{bmatrix} d^H(\omega, \theta_1) \\ d^H(\omega, \theta_2) \\ \vdots \\ d^H(\omega, \theta_M) \end{bmatrix},$$

where $$d^H(\omega, \theta_i) = \left[e^{-j\omega\frac{r_1-r_s}{c}} e^{-j\omega\frac{r_2-r_s}{c}} \ldots e^{-j\omega\frac{r_N-r_s}{c}}\right]^T,$$

i=1, 2, . . . , M.

A formula for calculating a response matrix β is as follows:

$$\beta=[\beta_1\beta_2 \ldots \beta_M]^T.$$

$x_n$ represents a horizontal coordinate of the $n^{th}$ microphone in the microphone array, $y_n$ represents a vertical coordinate of the $n^{th}$ microphone in the microphone array, $\theta_i$ represents an $i^{th}$ set incident angle of the sound source, $r_s$ represents a distance between the sound source and the center position of the microphone array, ω is a frequency of an audio signal, c represents a sound velocity, N represents a quantity of microphones in the microphone array, M represents a quantity of set incident angles of the sound source, and $\beta_i$, i=1, 2, . . . , M represents a response value corresponding to the $i^{th}$ set incident angle of the sound source.

Further, in this embodiment of the present disclosure, the differential beamforming weighting coefficient is determined in two manners: considering the position of the loudspeaker and not considering the position of the loudspeaker. When the position of the loudspeaker is not considered, D(ω,θ) and β may be determined according to the geometric shape of the microphone array and a set audio collection effective area. When the position of the loudspeaker is considered, D(ω,θ) and β may be determined according to the geometric shape of the microphone array, a set audio collection effective area, and the position of the loudspeaker.

Furthermore, in this embodiment of the present disclosure, when D(ω,θ) and β are determined according to the geometric shape of the microphone array and the set audio collection effective area, the set audio effective area is converted into a pole direction and a null direction according to output signal types required by different application scenarios, and D(ω,θ) and β in different application scenarios are determined according to the pole direction and the null direction that are obtained after the conversion. The pole direction is an incident angle that enables a response value of a super-directional differential beam in this direction to be 1, and the null direction is an incident angle that enables a response value of a super-directional differential beam in this direction to be 0.

Further, in this embodiment of the present disclosure, when D(ω,θ) and β are determined according to the geometric shape of the microphone array, the set audio collection effective area, and the position of the loudspeaker, according to output signal types required by different application scenarios, the set audio effective area is converted into a pole direction and a null direction and the position of the loudspeaker is converted into a null direction, and $D(\omega,\theta)$ and $\beta$ in different application scenarios are determined according to the pole direction and the null directions that are obtained after the conversion. The pole direction is an incident angle that enables a response value of a super-directional differential beam in this direction to be 1, and the null direction is an incident angle that enables a response value of a super-directional differential beam in this direction to be 0.

Furthermore, in this embodiment of the present disclosure, that the set audio effective area is converted into the pole direction and the null direction according to output signal types required by different application scenarios further includes, when an output signal type required by an application scenario is a mono signal, setting an end-fire direction of the microphone array as the pole direction, and setting M null directions, where $M \leq N-1$, and N represents a quantity of microphones in the microphone array, or when an output signal type required by an application scenario is a dual-channel signal, setting a 0-degree direction of the microphone array as the pole direction, and setting a 180-degree direction of the microphone array as the null direction, in order to determine a super-directional differential beamforming weighting coefficient corresponding to one channel in dual channels, and setting the 180-degree direction of the microphone array as the pole direction, and setting the 0-degree direction of the microphone array as the null direction, in order to determine a super-directional differential beamforming weighting coefficient corresponding to the other channel.

In this embodiment of the present disclosure, when a beam shape is to be set, an angle when a response vector of a beam is 1, a quantity of beams whose response vector is 0 (hereinafter referred to as a quantity of null points), and an angle of each null point may be set, or a degree of response at different angles may be set, or an angle range of an interested area may be set. In this embodiment of the present disclosure, an example in which the microphone array is a linear array including N microphones is used for description.

It is assumed that a quantity of null points for beamforming is set to L, and when an angle of each null point is $\theta_l$, $l=1, 2, \ldots, L$, $L \leq N-1$. According to periodicity of a cosine function, $\theta_l$ may be any angle. Because the cosine function has symmetry, $\theta_l$ is generally an angel within only (0,180].

Further, when the microphone array is a linear array including N microphones, an end-fire direction of the microphone array may be adjusted, such that the end-fire direction points to a set direction, for example, the end-fire direction points to a direction of a sound source. The adjustment may be performed manually, or the adjustment may be performed automatically according to a preset rotation angle, and a relatively common rotation angle is 90 degrees of clockwise rotation. Certainly, the microphone array may also be used to detect a direction of a sound source, and then the end-fire direction of the microphone array is turned to the sound source. FIG. 3A is a schematic diagram of a microphone array after a direction is adjusted. In this embodiment of the present disclosure, an end-fire direction of the microphone array, that is, a 0-degree direction, is used as a pole direction, and a response vector is 1. In this case, a steering matrix $D(\omega,\theta)$ becomes:

$$D(\omega, \theta) = \begin{bmatrix} d^H(\omega, 1) \\ d^H(\omega, \cos\theta_1) \\ \vdots \\ d^H(\omega, \cos\theta_L) \end{bmatrix},$$

and a response matrix $\beta$ becomes: $\beta=[1\ 0\ \ldots\ 0]^T$.

It is assumed that the angle range of the interested area is set to $[-\gamma,\gamma]$, where $\gamma$ represents an angle from 0 degrees to 180 degrees (including 0 degrees and 180 degrees). In this case, the end-fire direction may be set as the pole direction, a response vector may be set to 1, and a first null point may be set to $\gamma$, that is, $\theta_1=\gamma$, and for another null point, $$\theta_{z+1} = \left[\frac{180-\gamma}{N-z}\right]z + \gamma,$$

$z=1, 2, \ldots, K$, $K \leq N-2$. In this case, a steering matrix $D(\omega,\theta)$ becomes:

$$D(\omega, \theta) = \begin{bmatrix} d^H(\omega, 1) \\ d^H(\omega, \cos\gamma) \\ d^H(\omega, \cos\theta_2) \\ \vdots \\ d^H(\omega, \cos\theta_{K+1}) \end{bmatrix},$$

and a response matrix $\beta$ becomes: $\beta=[1\ 0\ \ldots\ 0]^T$.

When the angle range of the interested area is set to $[-\gamma,\gamma]$, the end-fire direction may be set as the pole direction, a response vector may be set to 1, and a first null point may be set to $\gamma$, that is, $\theta_1=\gamma$, and a quantity of other null points and positions of other null points are determined according to a preset distance $\sigma$ between null points.

$$\theta_{z+1} = \sigma z + \gamma,\ z = 1, 2 \ldots, \left[\frac{180-\gamma}{\sigma}\right].$$

However, $$\left[\frac{180-\gamma}{\sigma}\right] \leq N-2$$

should be ensured. If this condition is not met, a maximum value of z is $N-2$.

Further, in this embodiment of the present disclosure, to effectively eliminate an effect of an echo problem that is caused by playing sound by a loudspeaker on the entire apparatus performance, an angle of the loudspeaker may be preset to an angle of a null point direction, and the loudspeaker in this embodiment of the present disclosure may adopt a loudspeaker inside the apparatus or may adopt a peripheral loudspeaker.

Figure 4A:
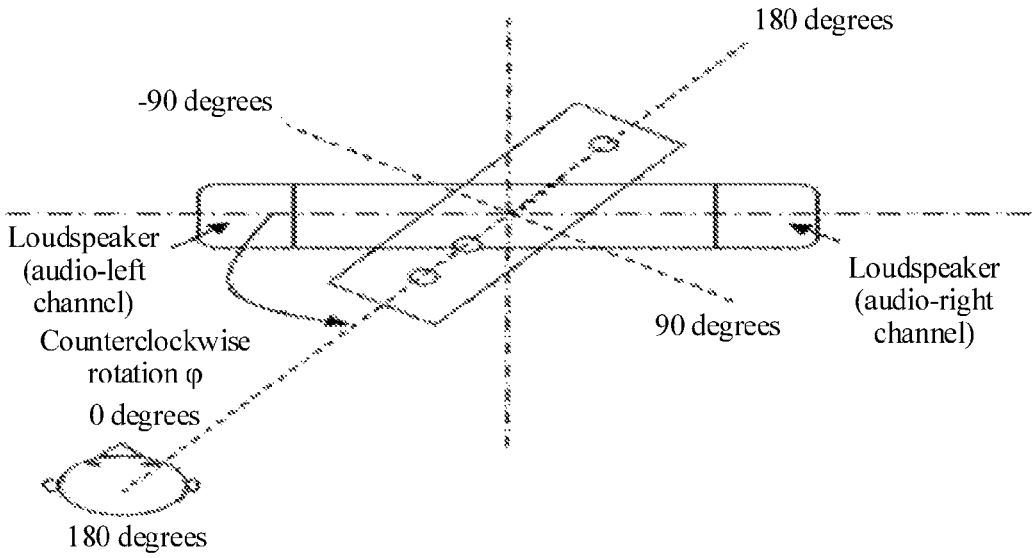
FIG. 4A and FIG. 4B are schematic diagrams of angle correlation between an end-fire direction of a microphone array and a loudspeaker according to an embodiment of the present disclosure.

FIG. 4A is a schematic diagram of angle correlation between an end-fire direction of a microphone array and a loudspeaker when the loudspeaker inside an apparatus is used in this embodiment of the present disclosure. It is assumed that a counterclockwise rotation angle of the microphone array is marked as $\phi$. After rotation, an angle between the loudspeaker and the end-fire direction of the microphone array is changed from original 0 degrees and 180 degrees to $-\phi$ degrees and $180-\phi$ degrees. In this case, positions indicated by $-\phi$ degrees and $180-\phi$ degrees are default null points, and response vectors are 0. When null points are to be set, the positions indicated by $-\phi$ degrees and $180-\phi$ degrees may be set as the null points. That is, when a quantity of null points is to be set, a quantity of angle values that can be set is reduced by 2. In this case, a steering matrix D(ω,θ) becomes:

$$D(\omega,\theta)=\begin{bmatrix} d^H(\omega,1) \\ d^H(\omega,\cos-\varphi) \\ d^H(\omega,\cos 180-\varphi) \\ d^H(\omega,\cos\theta_4) \\ \vdots \\ d^H(\omega,\cos\theta_M) \end{bmatrix}, M\le N,$$

where M is a positive integer.

Figure 4B:
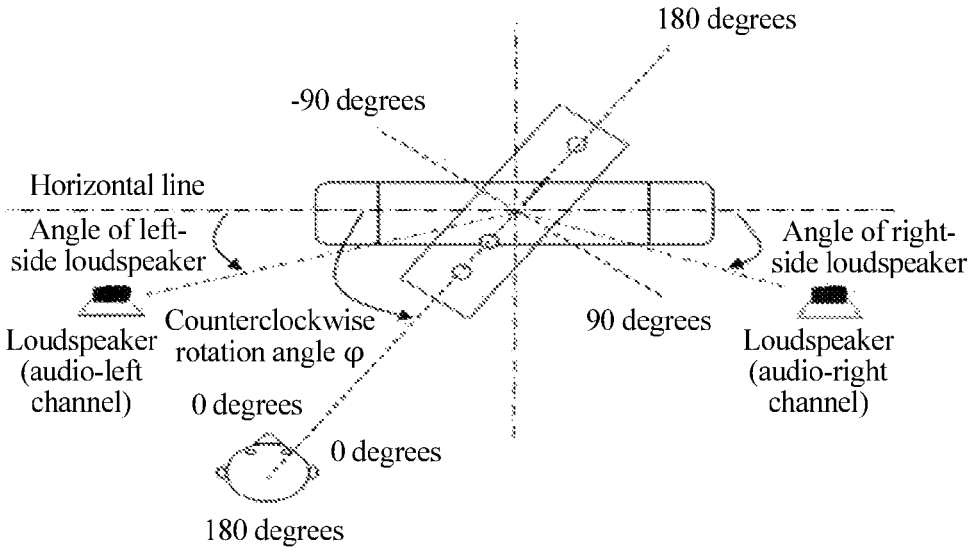

FIG. 4B is a schematic diagram of angle correlation between an end-fire direction of a microphone array and a loudspeaker when the loudspeaker outside an apparatus is used in this embodiment of the present disclosure. It is assumed that an angle between a left loudspeaker and a horizontal line of an original position of the microphone array is $\delta_1$, an angle between a right loudspeaker and the original position of the microphone array is $\delta_2$, and a counterclockwise rotation angle of the microphone array is ϕ. Then, after the microphone array is rotated, an angle between the left loudspeaker and the microphone array is changed from original $-\delta_1$ degrees to $-\phi+\delta_1$ degrees, and an angle between the right loudspeaker and the microphone array is changed from original $180-\delta_2$ degrees to $180-\phi-\delta_2$ degrees. In this case, positions indicated by $-\phi+\delta_1$ degrees and $180-\phi-\delta_2$ degrees are default null points, and response vectors are 0. When null points are to be set, the positions indicated by $-\phi+\delta_1$ degrees and $180-\phi-\delta_2$ degrees may be set as the null points. That is, when a quantity of null points is to be set, a quantity of angle values that can be set is reduced by 2. In this case, a steering matrix D(ω,θ) becomes:

$$D(\omega,\theta)=\begin{bmatrix} d^H(\omega,1) \\ d^H(\omega,\cos-\varphi+\delta_1) \\ d^H(\omega,\cos 180-\varphi-\delta_2) \\ d^H(\omega,\cos\theta_4) \\ \vdots \\ d^H(\omega,\cos\theta_M) \end{bmatrix}, M\le N,$$

where M is a positive integer.

It should be noted that the foregoing process of determining a weighting coefficient in this embodiment of the present disclosure is applied to forming a mono super-directional differential beamforming weighting coefficient in a case in which an output signal type required by an application scenario is a mono signal.

When an output signal type required by an application scenario is a dual-channel signal, and when an audio-left channel super-directional differential beamforming weighting coefficient corresponding to the current application scenario and an audio-right channel super-directional differential beamforming weighting coefficient corresponding to the current application scenario are to be determined, a steering matrix D(ω,θ) may be determined in the following manner.

Figure 5:
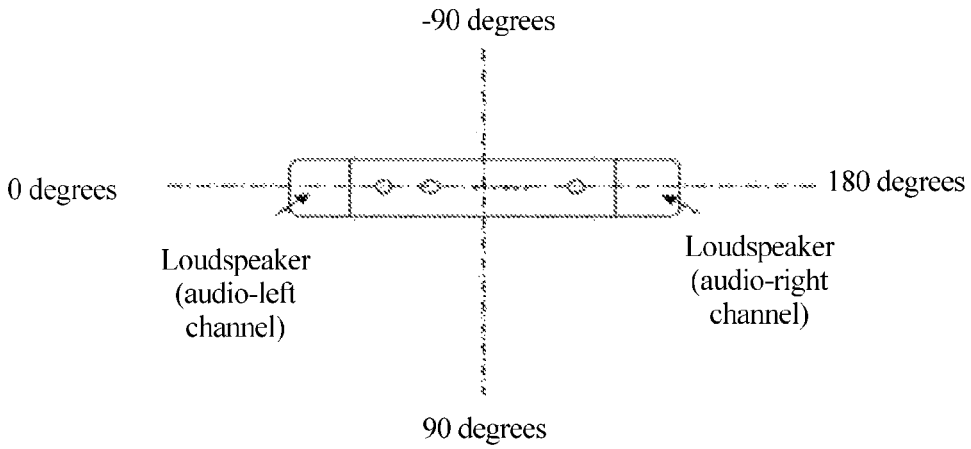
FIG. 5 is a schematic diagram of an angle of a microphone array that forms two audio signals according to an embodiment of the present disclosure.

FIG. 5 is a schematic diagram of an angle of a microphone array that is used to form a dual-channel audio signal according to an embodiment of the present disclosure. When the audio-left channel super-directional differential beamforming weighting coefficient corresponding to the current application scenario is to be determined, a 0-degree direction is used as a pole direction, and a response vector is 1, and a 180-degree direction is used as a null direction, and a response vector is 0. In this case, a steering matrix D(ω,θ) becomes:

$$D(\omega,\theta)=\begin{bmatrix} d^H(\omega,1) \\ d^H(\omega,-1) \end{bmatrix},$$

and a response matrix β becomes: β=[1 0].

When the audio-right channel super-directional differential beamforming weighting coefficient corresponding to the current application scenario is to be determined, a 180-degree direction is used as a pole direction, and a response vector is 1; and a 0-degree direction is used as a null direction, and a response vector is 0. In this case, a steering matrix D(ω,θ) becomes:

$$D(\omega,\theta)=\begin{bmatrix} d^H(\omega,-1) \\ d^H(\omega,1) \end{bmatrix},$$

and a response matrix β becomes: β=[1 0].

Further, the null direction and the pole direction of an audio-left channel super-directional differential beamforming weighting coefficients and those of the audio-right channel super-directional differential beamforming weighting coefficients are symmetric. Therefore, only an audio-left channel weighting coefficient or an audio-right channel weighting coefficient needs to be calculated, and the calculated weighting coefficient may be used as another weighting coefficient that is not calculated, as long as an order in which microphone signals are input is changed to a reversed order when the weighting coefficient is used.

It should be noted that in this embodiment of the present disclosure, when a weighting coefficient is to be determined, the foregoing set beam shape may be a preset beam shape, or may be an adjusted beam shape.

2. Perform Super-Directional Differential Beamforming Processing, in Order to Obtain a Super-Directional Differential Beamforming Signal.

In this embodiment of the present disclosure, a super-directional differential beamforming signal in a current application scenario is formed according to the acquired weighting coefficient and an audio input signal. Audio input signals are different in different application scenarios. When in an application scenario, echo cancellation processing needs to be performed on an original audio signal collected by a microphone array, the audio input signal is an audio signal that is obtained after echo cancellation is performed on the original audio signal collected by the microphone array, which is determined according to the current application scenario. When in an application scenario, echo cancellation processing does not need to be performed on an original audio signal collected by a microphone array, the original audio signal collected by the microphone array is used as the audio input signal.

Further, after the audio input signal and the weighting coefficient are determined, super-directional differential beamforming processing is performed on the audio input signal according to the determined weighting coefficient, in order to obtain a processed super-directional differential beamforming output signal.

Fast discrete Fourier transform is generally performed on the audio input signal to obtain a frequency domain signal $X_i(k)$ corresponding to each audio input signal, where i=1, 2, . . . , N, and k=1, 2, . . . , FFT_LEN, where FFT_LEN is a transform length for the fast discrete Fourier transform. According to a characteristic of the discrete Fourier transform, a transformed signal has a characteristic of complex symmetry, and $X_i(FFT_LEN+2-k)=X_i^*(k)$, where k=2, . . . , FFT_LEN/2, and * represents conjugation. Therefore, a quantity of effective frequency bins of a signal obtained after the discrete Fourier transform is FFT_LEN/2+1. Generally, only a super-directional differential beamforming weighting coefficient corresponding to an effective frequency bin is stored. Super-directional differential beamforming processing is performed on an audio input signal in the frequency domain using a formula $Y(k)=h^T(\omega_k)X(k)$, where k=1, 2, . . . , FFT_LEN/2+1, and a formula $Y_i(FFT_LEN+2-k)=Y^*(k)$, where k=2, . . . , FFT_LEN/2, in order to obtain a super-directional differential beamforming signal in the frequency domain. Y(k) represents the super-directional differential beamforming signal in the frequency domain, $h(\omega_k)$ represents a $k^{th}$ group of weighting coefficients, and $X(k)=[X_1(k), X_2(k), \ldots, X_N(k)]^T$, where $X_i(k)$ represents a frequency domain signal corresponding to an $i^{th}$ audio signal that is obtained after echo cancellation is performed on the original audio signal collected by the microphone array, or a frequency domain signal corresponding to an $i^{th}$ original audio signal collected by the microphone array.

Further, in this embodiment of the present disclosure, when a channel signal required by an application scenario is a mono signal, a mono super-directional differential beamforming weighting coefficient for forming the mono signal in the current application scenario is acquired, and super-directional differential beamforming processing is performed on an audio input signal according to the acquired mono super-directional differential beamforming weighting coefficient, in order to form one mono super-directional differential beamforming signal, or when a channel signal required by an application scenario is a dual-channel signal, an audio-left channel super-directional differential beamforming weighting coefficient corresponding to the current application scenario and an audio-right channel super-directional differential beamforming weighting coefficient corresponding to the current application scenario are separately acquired, and super-directional differential beamforming processing is performed on an audio input signal according to the acquired audio-left channel super-directional differential beamforming weighting coefficient corresponding to the current application scenario, in order to obtain an audio-left channel super-directional differential beamforming signal corresponding to the current application scenario, and super-directional differential beamforming processing is performed on an audio input signal according to the acquired audio-right channel super-directional differential beamforming weighting coefficient corresponding to the current application scenario, in order to obtain an audio-right channel super-directional differential beamforming signal corresponding to the current application scenario.

Further, in this embodiment of the present disclosure, to better collect an original audio signal, when the output signal type required by the current application scenario is a mono signal, an end-fire direction of the microphone array is adjusted, such that the end-fire direction points to a target sound source, an original audio signal of the target sound source is collected, and the collected original audio signal is used as the audio input signal.

Figure 6:
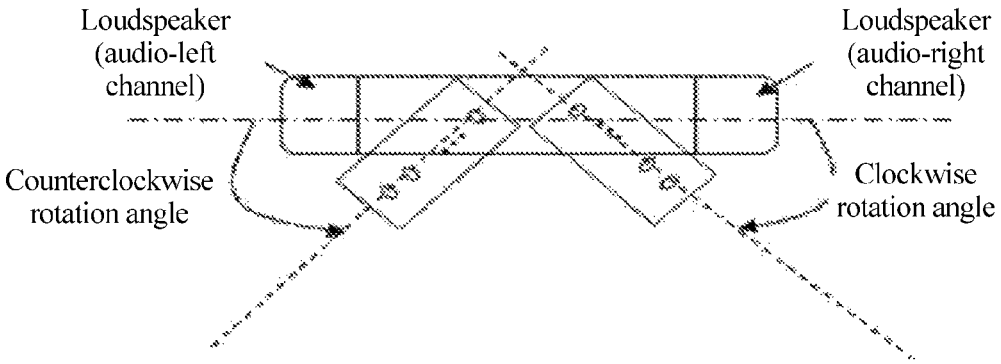
FIG. 6 is a schematic diagram obtained after a microphone array is divided into two subarrays according to an embodiment of the present disclosure.

Still further, in this embodiment of the present disclosure, when a channel signal required by an application scenario is a dual-channel signal, for example, in application scenarios such as spatial sound field recording and stereo recording, the microphone array may be divided into two subarrays: a first subarray and a second subarray, where an end-fire direction of the first subarray is different from an end-fire direction of the second subarray. The first subarray and the second subarray each are used to collect an original audio signal. A super-directional differential beamforming signal in the current application scenario is formed according to the original audio signals collected by the two subarrays, an audio-left channel super-directional differential beamforming weighting coefficient, and an audio-right channel super-directional differential beamforming weighting coefficient, or according to audio signals that are obtained after echo cancellation is performed on the original audio signals collected by the two subarrays, an audio-left channel super-directional differential beamforming weighting coefficient, and an audio-right channel super-directional differential beamforming weighting coefficient. FIG. 6 is a schematic diagram obtained after a microphone array is divided into two subarrays. An audio signal collected by one subarray is used to form the audio-left channel super-directional differential beamforming signal, and an audio signal collected by the other subarray is used to form the audio-right channel super-directional differential beamforming signal.

3. Perform Processing on a Formed Super-Directional Differential Beam.

In this embodiment of the present disclosure, after the super-directional differential beam is formed, whether noise suppression and/or echo suppression processing is performed on the super-directional differential beam may be determined according to an actual application scenario, and a specific noise suppression processing manner and echo suppression processing manner may be implemented in multiple implementation manners.

In this embodiment of the present disclosure, to achieve a better directional suppression effect, when the super-directional differential beam is to be formed, Q weighting coefficients that are different from the foregoing super-directional differential beamforming weighting coefficient may be calculated, in order to obtain, in another direction, except a direction of a sound source, in adjustable end-fire directions of a microphone array using the super-directional differential beamforming weighting coefficient, Q beamforming signals as reference noise signals to perform noise suppression, where Q is an integer that is not less than 1, in order to achieve a better directional noise suppression effect.

According to the audio signal processing method provided in this embodiment of the present disclosure, when a super-directional differential beamforming weighting coefficient is to be determined, a geometric shape of a microphone array may be flexibly set, and there is no need to set multiple microphone arrays. There is no high requirement on a manner for arranging the microphone array, and therefore costs of arranging microphones are reduced. In addition, when an audio collection area is adjusted, a weighting coefficient is determined again according to an adjusted audio collection effective area, and super-directional differential beamforming processing is performed according to the adjusted weighting coefficient, which can improve experience.

Applications of the foregoing audio signal processing method are described in the following embodiments of the present disclosure using examples and with reference to specific application scenarios, such as human computer interaction, high definition voice communication, spatial sound field recording, and a stereo call. Certainly, applications of the foregoing audio signal processing method are not limited thereto.

Embodiment 3

In this embodiment of the present disclosure, an audio signal processing method in human computer interaction and high definition voice communication processes that require a mono signal is described using an example.

Figure 7:
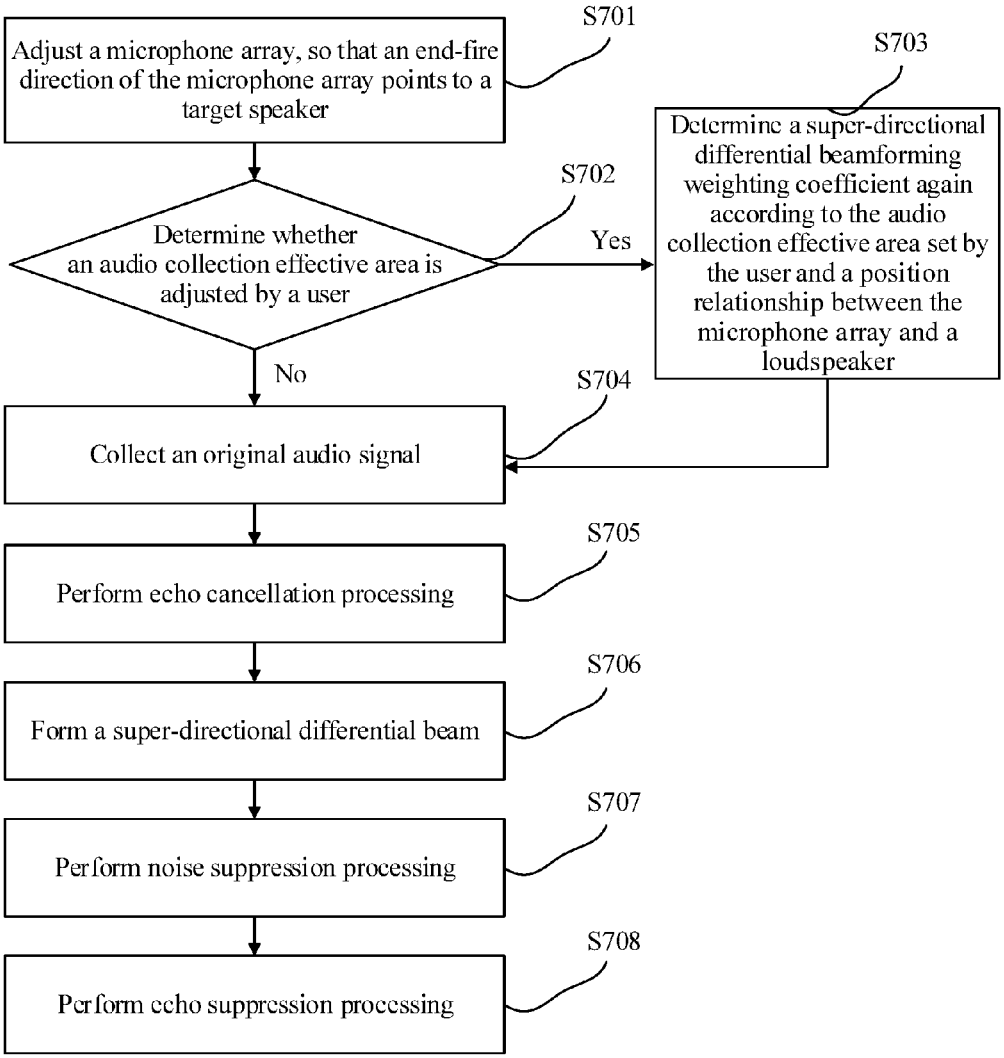
FIG. 7 is a flowchart of an audio signal processing method in a process of human computer interaction and high definition voice communication according to an embodiment of the present disclosure.

FIG. 7 is a flowchart of an audio signal processing method in human computer interaction and high definition voice communication processes according to an embodiment of the present disclosure. The method includes the following steps:

Step S701: Adjust a microphone array, so that an end-fire direction of the microphone array points to a target speaker, that is, a sound source.

In this embodiment of the present disclosure, when the microphone array may be adjusted manually, or may be adjusted automatically according to a preset rotation angle, and the microphone array may also be used to detect a direction of a speaker, and then the end-fire direction of the microphone array is turned to a target speaker. There are multiple methods for detecting a direction of a speaker using a microphone array, such as a sound source localization technology based on a multiple signal classification (MUSIC) algorithm, a steering response power phase transform (SRP-PHAT) technology, and a generalized cross correlation phase transform (GCC-PHAT) technology.

Step S702: Determine whether an audio collection effective area is adjusted by a user; when the audio collection effective area is adjusted by the user, proceed to step S703 to determine a super-directional differential beamforming weighting coefficient again. When the audio collection effective area is not adjusted by the user, skip updating a super-directional differential beamforming weighting coefficient, and perform step S704 using a predetermined super-directional differential beamforming weighting coefficient.

Step S703: Determine the super-directional differential beamforming weighting coefficient again according to the audio collection effective area set by the user and a position relationship between the microphone array and a loudspeaker.

In this embodiment of the present disclosure, when the audio collection effective area is set again by the user, the super-directional differential beamforming weighting coefficient may be determined again using a calculation method, which is according to Embodiment 2, for determining a super-directional differential beamforming weighting coefficient according to.

Step S704: Collect an original audio signal.

In this embodiment of the present disclosure, a microphone array including N microphones is used to collect original audio signals picked up by the N microphones, and a data signal played by a loudspeaker is synchronously and temporarily stored, where the data signal played by the loudspeaker is used as a reference signal for echo suppression and echo cancellation, and framing processing is performed on the signal. It is assumed that the original audio signals picked up by the N microphones are $x_i(n)$, where i=1, 2, . . . , N; and data that is played by the loudspeaker and synchronously and temporarily stored is $ref_j(n)$, j=1, 2, . . . , Q, where j=1, 2, . . . , Q, and Q represents a quantity of channels on which the loudspeaker plays the data.

Step S705: Perform echo cancellation processing.

In this embodiment of the present disclosure, echo cancellation is performed, according to the data that is played by the loudspeaker and synchronously and temporarily stored, on the original audio signal picked up by each microphone in the microphone array, and each echo-canceled audio signal is marked as $x'_i(n)$, where i=1, 2, . . . , N. A specific echo cancellation algorithm may be implemented in multiple implementation manners, and details are not described herein again.

It should be noted that in this embodiment of the present disclosure, if a quantity of channels on which the loudspeaker plays data is greater than 1, a multichannel echo cancellation algorithm needs to be used to perform processing, if a quantity of channels on which the loudspeaker plays data is equal to 1, a mono echo cancellation algorithm may be used to perform processing.

Step S706: Form a super-directional differential beam.

In this embodiment of the present disclosure, fast discrete Fourier transform is performed on each echo-canceled signal to obtain a frequency domain signal $X'_i(k)$ corresponding to each echo-canceled signal, where i=1, 2, . . . , FFT_LEN, and FFT_LEN is a transform length for the fast discrete Fourier transform. According to a characteristic of the discrete Fourier transform, a transformed signal has a characteristic of complex symmetry, and $X_i(FFT_LEN+2-k)=X_i^*(k)$, where k=2, FFT_LEN/2, and * represents conjugation. Therefore, a quantity of effective frequency bins of a signal obtained after the discrete Fourier transform is FFT_LEN/2+1. Generally, only a super-directional differential beamforming weighting coefficient corresponding to an effective frequency bin is stored. Using the following formulas:

$$Y(k)=h^T(\omega_k)X(k),k=1,2,\ldots,FFT_LEN/2+1,$$

$$Y_i(FFT_LEN+2-k)=Y^*(k),k=2,\ldots,FFT_LEN/2,$$

super-directional differential forming beam processing is performed on the frequency domain signal of the echo-canceled audio input signal to obtain a super-directional differential beamforming signal in a frequency domain, where Y(k) represents the super-directional differential beamforming signal in the frequency domain, $h(\omega_k)$ represents a $k^{th}$ group of weighting coefficients, and $X(k)=[X_1(k), X_2(k), \ldots, X_N(k)]^T$. Finally, the super-directional differential beamforming signal in the frequency domain is transformed to a time domain using inverse transform of fast discrete Fourier transform, in order to obtain a super-directional differential beamforming output signal y(n).

Further, in this embodiment of the present disclosure, Q beamforming signals that are used as reference noise signals may further be obtained in a same manner in any other direction except a direction of the target speaker. However, corresponding Q super-directional differential beamforming weighting coefficients used to generate Q reference noise signals need to be calculated again, and a calculation method is similar to the foregoing method. For example, a determined direction except the direction of the target speaker may be used as a pole direction of a beam, and a response vector is 1. A direction that is opposite to the pole direction is a null direction, and a response vector is 0, and Q super-directional differential beamforming weighting coefficients may be calculated according to determined Q directions.

Step S707: Perform noise suppression processing.

Noise suppression processing is performed on the super-directional differential beamforming output signal y(n) to obtain a noise-suppressed signal y'(n).

Further, in this embodiment of the present disclosure, when the super-directional differential beam is formed in step S706, if Q reference noise signals are formed at the same time, the Q reference noise signals may be used to perform further noise suppression processing, in order to achieve a better directional noise suppression effect.

Step S708: Perform echo suppression processing.

Echo suppression processing is performed, according to the data that is played by the loudspeaker and synchronously and temporarily stored, on the noise-suppressed signal y'(n), in order to obtain a final output signal z(n).

It should be noted that in this embodiment of the present disclosure, step S708 is optional. That is, echo suppression processing may be performed or echo suppression processing may not be performed. In addition, execution sequences of step S707 and step S706 in this embodiment of the present disclosure are not limited. That is, noise suppression processing may be performed first and then echo suppression processing is performed, or echo suppression processing may be performed first and then noise suppression processing is performed.

Further, in this embodiment of the present disclosure, execution sequences of step S705 and step S706 may also be interchanged. If the execution sequences of step S705 and step S706 are interchanged, when super-directional differential beamforming is performed, the audio input signal is changed from each echo-canceled signal $x'_i(n)$ to the collected original audio signal $x_i(n)$, where i=1, 2, . . . , N, and after super-directional differential beamforming processing is performed, the super-directional differential beamforming output signal y(n) obtained according to the N collected original audio signals is obtained, instead of a super-directional differential beamforming output signal obtained according to N echo-canceled signals. In addition, when echo cancellation processing is performed, the input signal is changed from the N collected original audio signals $x_i(n)$ to the super-directional differential beamforming signal y(n), where i=1, 2, . . . , N.

In a process of performing echo suppression processing, processing for original N channels may be simplified to processing for one channel using the foregoing audio signal processing manner.

It should be noted that if Q reference noise signals are generated using a super-directional differential beamforming method, null points need to be set at a position of a left loudspeaker and a position of a right loudspeaker, in order to avoid impact of an echo signal on noise suppression performance.

In this embodiment of the present disclosure, if an audio output signal that is obtained after the foregoing processing is applied in high definition voice communication, a final output signal is encoded and is transmitted to the other party of a call. If an audio output signal that is obtained after the foregoing processing is applied in human computer interaction, further processing is performed on a final output signal that is used as a front-end collection signal for voice recognition.

Embodiment 4

In this embodiment of the present disclosure, an audio signal processing method in spatial sound field recording that requires a dual-channel signal is described using an example.

Figure 8:
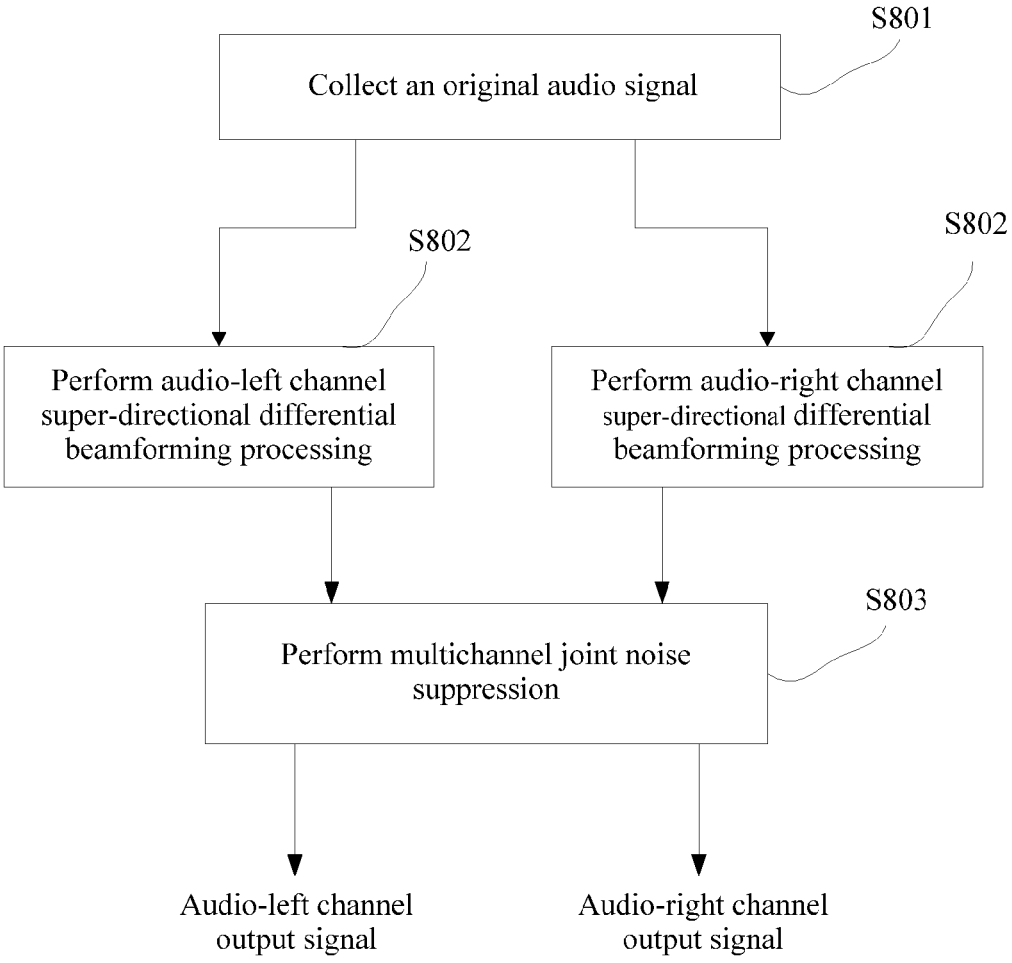
FIG. 8 is a flowchart of an audio signal processing method in a spatial sound field recording process according to an embodiment of the present disclosure.

FIG. 8 is a flowchart of an audio signal processing method in a spatial sound field recording process according to an embodiment of the present disclosure. The method includes the following steps:

Step S801: Collect an original audio signal.

Furthermore, in this embodiment of the present disclosure, original signals picked up by N microphones are collected, and framing processing is performed on the signals, such that the processed signals are used as original audio signals. It is assumed that N original audio signals are $x_i(n)$, where i=1, 2, . . . , N.

Step S802: Separately perform audio-left channel super-directional differential beamforming processing and audio-right channel super-directional differential beamforming processing.

In this embodiment of the present disclosure, an audio-left channel super-directional differential beamforming weighting coefficient corresponding to a current application scenario and an audio-right channel super-directional differential beamforming weighting coefficient corresponding to the current application scenario are calculated and stored in advance. The stored audio-left channel super-directional differential beamforming weighting coefficient corresponding to the current application scenario, the stored audio-right channel super-directional differential beamforming weighting coefficient corresponding to the current application scenario, and the original audio signal collected in step S801 are used to separately perform audio-left channel super-directional differential beamforming processing corresponding to the current application scenario and audio-right channel super-directional differential beamforming processing corresponding to the current application scenario, such that an audio-left channel super-directional differential beamforming signal $y_L(n)$ corresponding to the current application scenario and an audio-right channel super-directional differential beamforming signal $y_R$ (n) corresponding to the current application scenario can be obtained.

The audio-left channel super-directional differential beamforming weighting coefficient and the audio-right channel super-directional differential beamforming weighting coefficient in this embodiment of the present disclosure may be determined using the method for determining a weighting coefficient when an output signal type required by an application scenario is a dual-channel signal in Embodiment 2, and details are not described herein again.

Further, in this embodiment of the present disclosure, processes of performing audio-left channel super-directional differential beamforming processing and performing audio-right channel super-directional differential beamforming processing are similar to the processes of performing super-directional beamforming processing that are according to the foregoing embodiments. An audio input signal is the collected original audio signal $x_i(n)$ of the N microphones, and weighting coefficients are a super-directional differential beamforming weighting coefficient corresponding to an audio-left channel and a super-directional differential beamforming weighting coefficient corresponding to an audio-right channel.

Step S803: Perform multichannel joint noise suppression.

Multichannel noise suppression is used in this embodiment of the present disclosure. The audio-left channel super-directional differential beamforming signal $y_L(n)$ and the audio-right channel super-directional differential beamforming signal $y_R(n)$ are used as input signals for multichannel noise suppression, which can suppress noise, prevent drift in a sound image of a non-background noise signal, and ensure that sound of a processed stereo signal is not affected by residual noises of the audio-left channel and the audio-right channel.

It should be noted that multichannel noise suppression performed in this embodiment of the present disclosure is optional. That is, multichannel noise suppression may not be performed, but the audio-left channel super-directional differential beamforming signal $y_L(n)$ and the audio-right channel super-directional differential beamforming signal $y_R(n)$ directly form a stereo signal, and the stereo signal is output as a final spatial sound field recording signal.

Embodiment 5

In this embodiment of the present disclosure, an audio signal processing method in a stereo call is described using an example.

Figure 9:
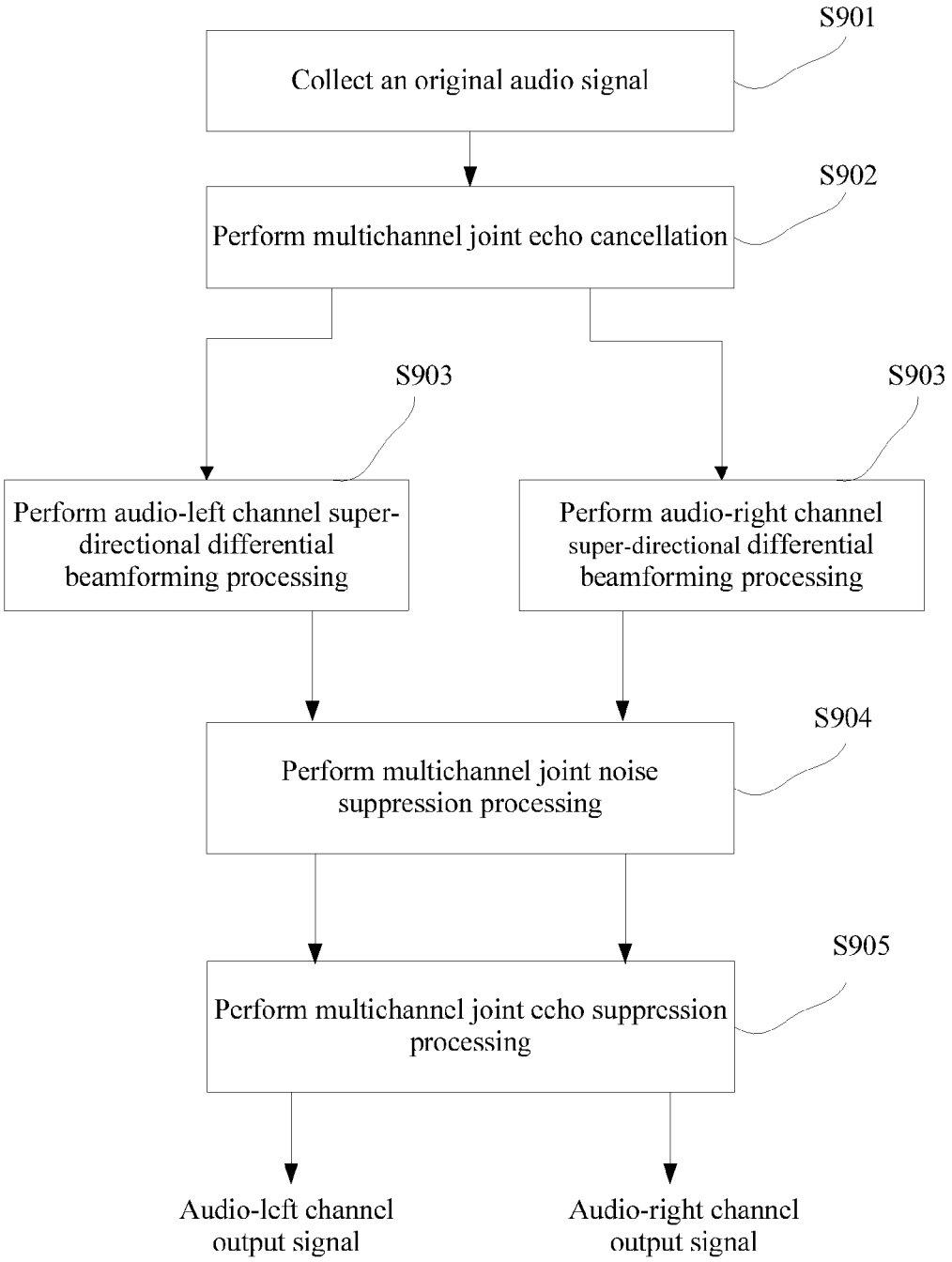
FIG. 9 is a flowchart of an audio signal processing method in a stereo call according to an embodiment of the present disclosure.

FIG. 9 is a flowchart of an audio signal processing method in a stereo call according to an embodiment of the present disclosure. The method includes the following steps.

Step S901: Collect original audio signals picked up by N microphones, synchronously and temporarily store data played by a loudspeaker, which are used as a reference signal for multichannel joint echo suppression and multichannel joint echo cancellation, and perform framing processing on the original audio signals and the reference signal. It is assumed that the original audio signals picked up by the N microphones are $x_i(n)$, where i=1, 2, . . . , N, and the data that is played by the loudspeaker and synchronously and temporarily stored is $ref_j(n)$, j=1, 2, . . . , Q, where Q represents a quantity of channels on which the loudspeaker plays the data, and in this embodiment of the present disclosure, Q=2.

Step S902: Perform multichannel joint echo cancellation.

Multichannel joint echo cancellation is performed, according to the data $ref_j(n)$, j=1, 2, . . . , Q that is played by the loudspeaker and synchronously and temporarily stored, on the original audio signal picked up by each microphone, and each echo-canceled signal is marked as $X'_i(n)$, where i=1, 2, . . . , N.

Step S903: Separately perform audio-left channel super-directional differential beamforming processing and audio-right channel super-directional differential beamforming processing.

Furthermore, in this embodiment of the present disclosure, processes of performing audio-left channel super-directional differential beamforming processing and performing audio-right channel super-directional differential beamforming processing are similar to step S802 in a processing procedure of spatial sound field recording in Embodiment 4, but an input signal is changed to each echo-canceled signal $x'_i(n)$, where i=1, 2, . . . , N. An audio-left channel super-directional differential beamforming signal $y_L(n)$ and an audio-right channel super-directional differential beamforming signal $y_R(n)$ are obtained after processing.

Step S904: Perform multichannel joint noise suppression processing.

Furthermore, in this embodiment of the present disclosure, a process of performing multichannel noise suppression processing is the same as the process in step S803 in Embodiment 4, and details are not described herein again.

Step S905: Perform multichannel joint echo suppression processing.

Furthermore, in this embodiment of the present disclosure, echo suppression processing is performed, according to the data that is played by the loudspeaker and synchronously and temporarily stored, on a signal that is obtained after multichannel noise suppression is performed, in order to obtain a final output signal.

It should be noted that multichannel joint echo suppression processing in this embodiment of the present disclosure is optional. That is, the processing may be performed, or the processing may not be performed. In addition, in this embodiment of the present disclosure, execution sequences of processes of performing multichannel joint echo suppression processing and performing multichannel noise suppression processing are not limited. That is, multichannel noise suppression processing may be performed first and then multichannel joint echo suppression processing is performed, or multichannel joint echo suppression processing may be performed first and then multichannel noise suppression processing is performed.

Embodiment 6

An embodiment of the present disclosure provides an audio signal processing method, which is applied in spatial sound field recording and a stereo call. In this embodiment of the present disclosure, a sound field collection manner may be adjusted according to a users requirement, and before an audio signal is collected, a microphone array is divided into two subarrays, and end-fire directions of the subarrays are separately adjusted, such that an original audio signal is collected using the two subarrays that are obtained by means of division.

Furthermore, in this embodiment of the present disclosure, a microphone array is divided into two subarrays, and end-fire directions of the subarrays are separately adjusted. The adjustment may be performed manually by a user, or the adjustment may be performed automatically according to an angle set by a user, or a rotation angle may be preset, and after a function of spatial sound field recording is enabled by an apparatus, a microphone array is divided into two subarrays, and end-fire directions of the subarrays are automatically adjusted to a preset direction. Generally, the rotation angle may be set to 45 degrees of left-side counterclockwise rotation, or 45 degrees of right-side clockwise rotation. Certainly, the rotation angle may also be randomly adjusted according to setting performed by a user. After the microphone array is divided into two subarrays, a signal collected by one subarray is used for audio-left channel super-directional differential beamforming, and a collected original signal is marked as $X_i(n)$, i=1, 2, . . . , $N_1$. A signal collected by the other subarray is used for audio-right channel super-directional differential beamforming, and a collected original signal is marked as $X_i(n)$, i=1, 2, . . . , $N_2$, where $N_1+N_2=N$.

Figure 10A:
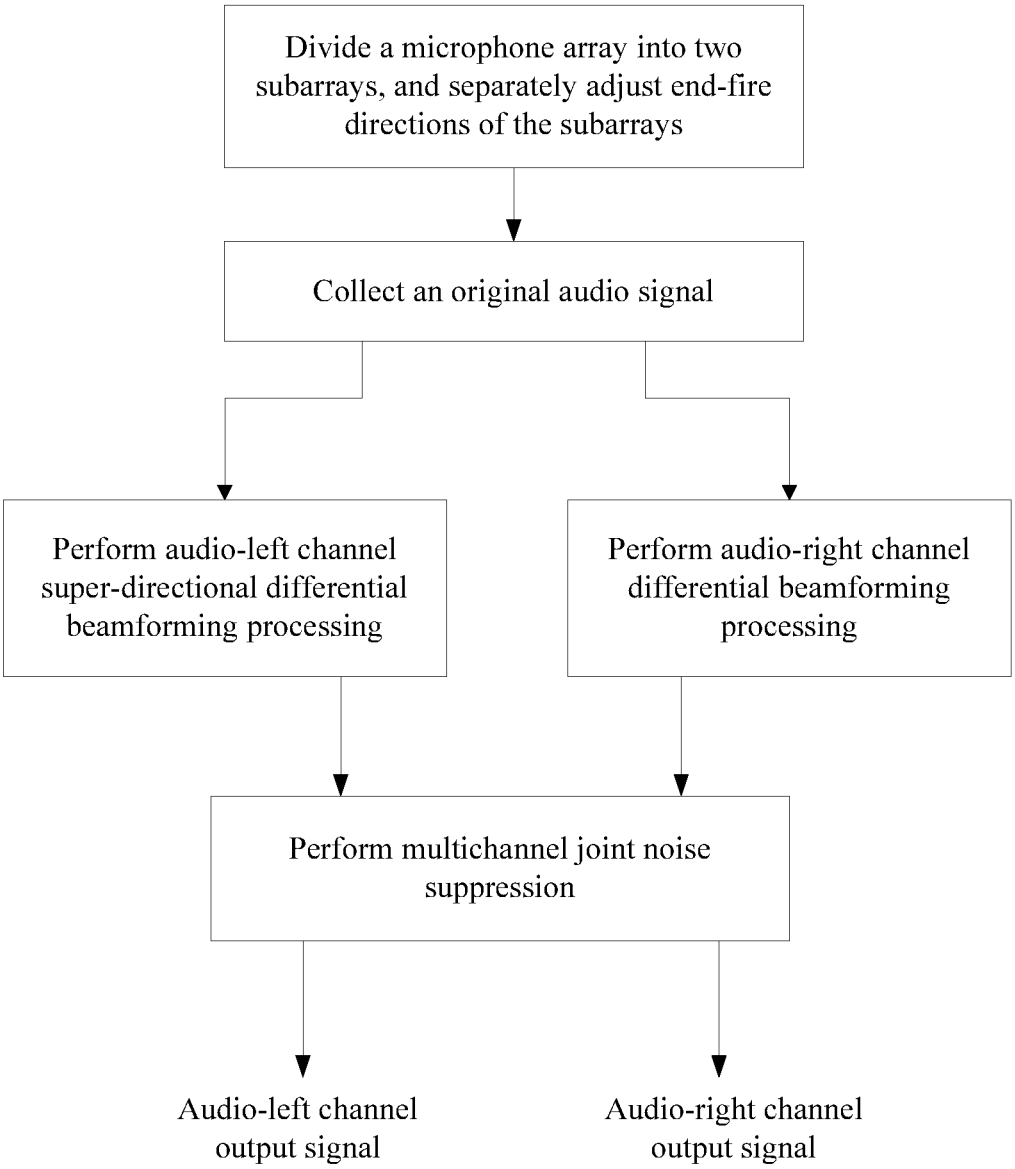
FIG. 10A is a flowchart of an audio signal processing method in a spatial sound field recording process.
Figure 10B:
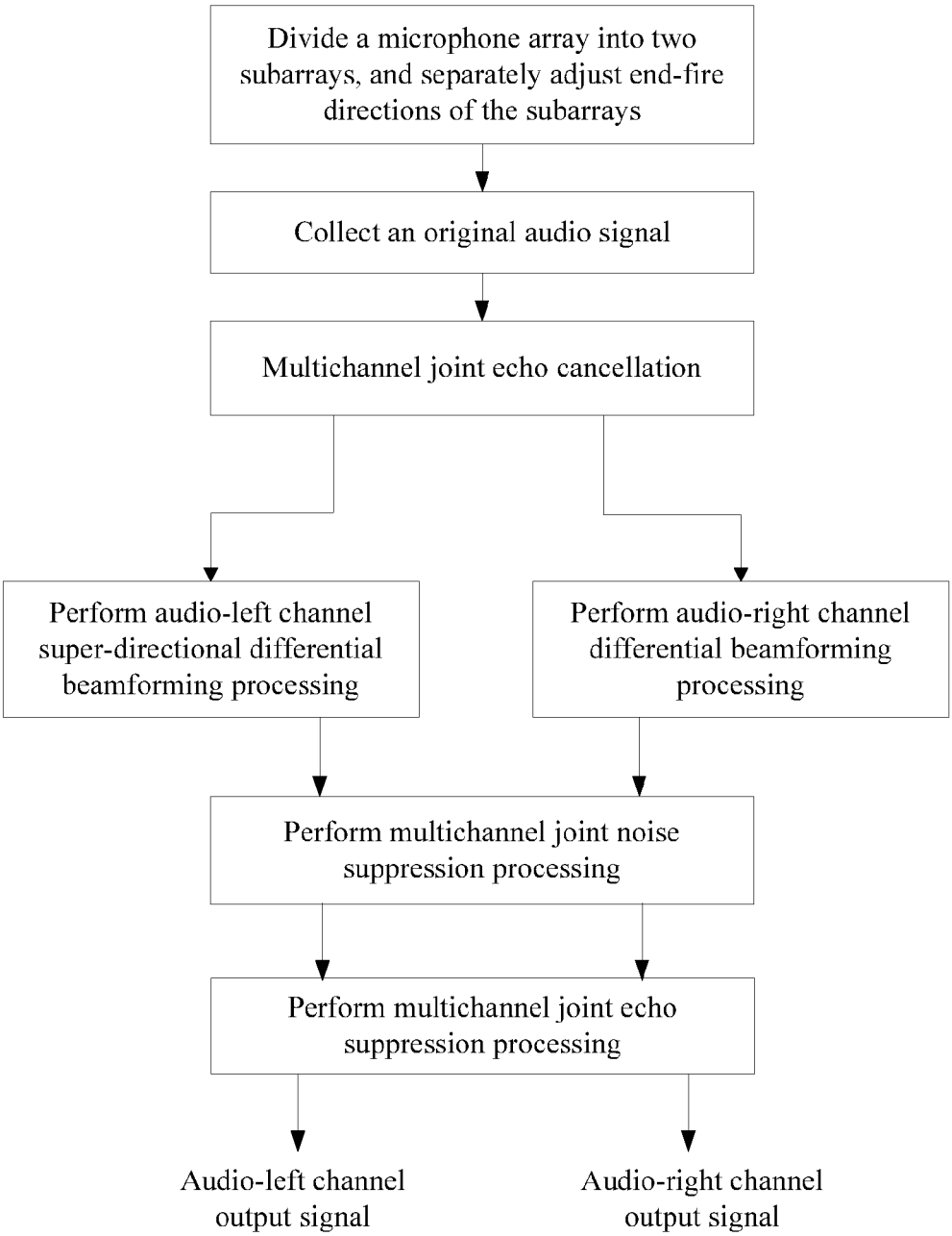
FIG. 10B is a flowchart of an audio signal processing method in a process of a stereo call.

In this embodiment of the present disclosure, an audio signal processing method when a microphone array is divided into two subarrays is shown in FIG. 10A and FIG. 10B. FIG. 10A is a flowchart of an audio signal processing method in a spatial sound field recording process, and FIG. 10B is a flowchart of an audio signal processing method in a stereo call process.

Embodiment 7

Figure 11A:
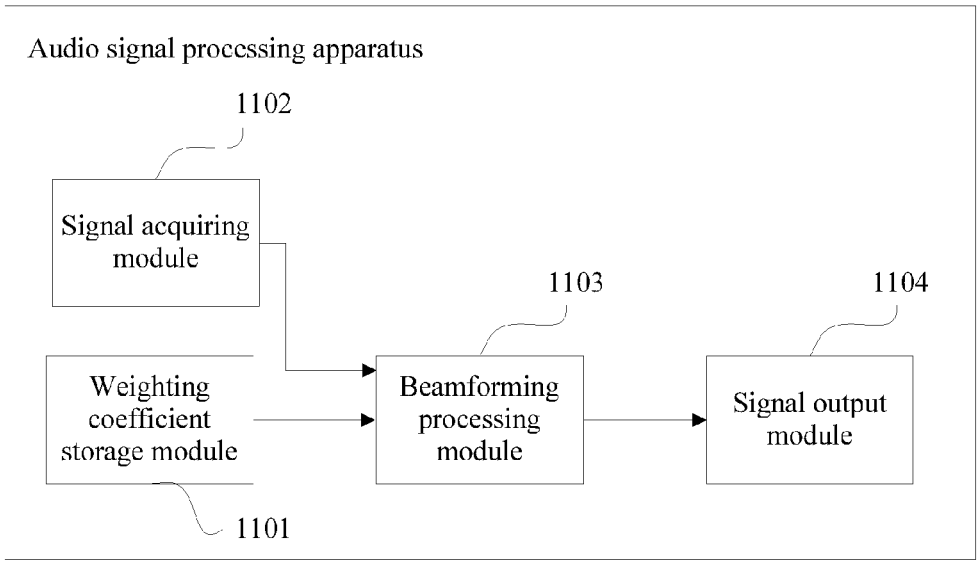
FIG. 11A to FIG. 11E are schematic structural diagrams of an audio signal processing apparatus according to an embodiment of the present disclosure.

Embodiment 7 of the present disclosure provides an audio signal processing apparatus. As shown in FIG. 11A, the apparatus includes a weighting coefficient storage module 1101, a signal acquiring module 1102, a beamforming processing module 1103, and a signal output module 1104.

The weighting coefficient storage module 1101 is configured to store a super-directional differential beamforming weighting coefficient.

The signal acquiring module 1102 is configured to acquire an audio input signal and transmit the acquired audio input signal to the beamforming processing module 1103, and is further configured to determine a current application scenario and an output signal type required by the current application scenario, and transmit the current application scenario and the output signal type required by the current application scenario to the beamforming processing module 1103.

The beamforming processing module 1103 is configured to select, according to the output signal type required by the current application scenario, a weighting coefficient corresponding to the current application scenario from the weighting coefficient storage module 1101, perform, using the determined weighting coefficient, super-directional differential beamforming processing on the audio input signal output by the signal acquiring module 1102, in order to obtain a super-directional differential beamforming signal, and transmit the super-directional differential beamforming signal to the signal output module 1104.

The signal output module 1104 is configured to output the super-directional differential beamforming signal transmitted by the beamforming processing module 1103.

The beamforming processing module 1103 is further configured to when the output signal type required by the current application scenario is a dual-channel signal, acquire an audio-left channel super-directional differential beamforming weighting coefficient and an audio-right channel super-directional differential beamforming weighting coefficient from the weighting coefficient storage module 1101, perform super-directional differential beamforming processing on the audio input signal according to the acquired audio-left channel super-directional differential beamforming weighting coefficient, in order to obtain an audio-left channel super-directional differential beamforming signal, perform super-directional differential beamforming processing on the audio input signal according to the audio-right channel super-directional differential beamforming weighting coefficient, in order to obtain an audio-right channel super-directional differential beamforming signal, and transmit the audio-left channel super-directional differential beamforming signal and the audio-right channel super-directional differential beamforming signal to the signal output module 1104.

The signal output module 1104 is further configured to output the audio-left channel super-directional differential beamforming signal and the audio-right channel super-directional differential beamforming signal.

The beamforming processing module 1103 is further configured to, when the output signal type required by the current application scenario is a mono signal, acquire, from the weighting coefficient storage module 1101, a mono super-directional differential beamforming weighting coefficient for forming the mono signal, where the mono super-directional differential beamforming weighting coefficient corresponds to the current application scenario, when the mono super-directional differential beamforming weighting coefficient is acquired, perform super-directional differential beamforming processing on the audio input signal according to the mono super-directional differential beamforming weighting coefficient, in order to form one mono super-directional differential beamforming signal, and transmit the obtained one mono super-directional differential beamforming signal to the signal output module 1104.

The signal output module 1104 is further configured to output the one mono super-directional differential beamforming signal.

Figure 11B:
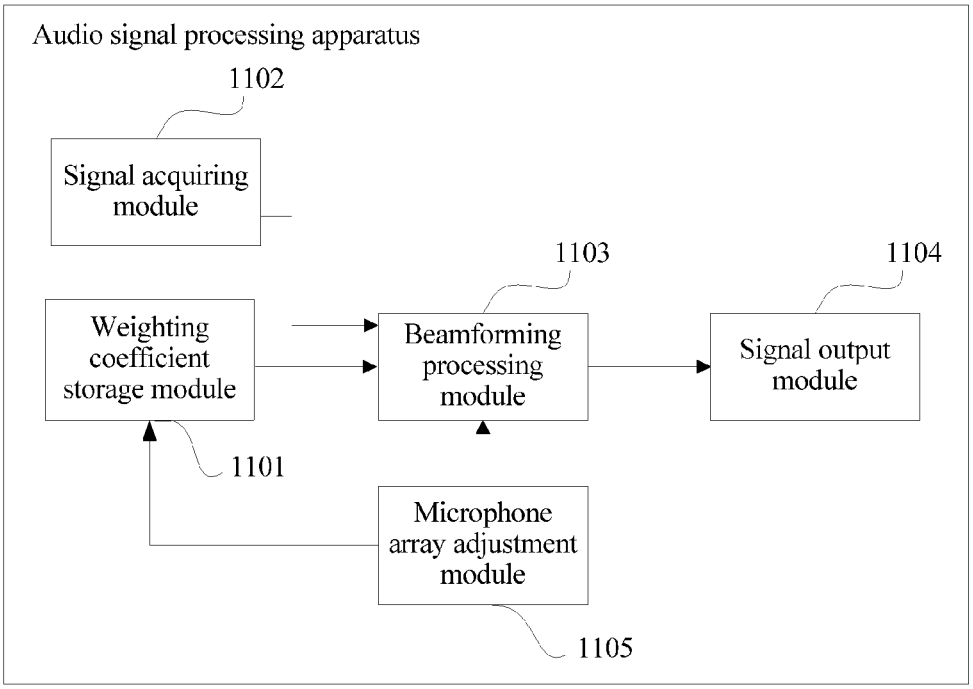

The apparatus further includes a microphone array adjustment module 1105, as shown in FIG. 11B.

The microphone array adjustment module 1105 is configured to adjust a microphone array to form a first subarray and a second subarray, where an end-fire direction of the first subarray is different from an end-fire direction of the second subarray, and the first subarray and the second subarray each collect an original audio signal, and transmit the original audio signal to the signal acquiring module 1102 as the audio input signal.

When the output signal type required by the current application scenario is a dual-channel signal, the microphone array is adjusted to form two subarrays, and end-fire directions of the two subarrays obtained by means of the adjustment point to different directions, in order to each collect an original audio signal that is used to perform audio-left channel super-directional differential beamforming processing and audio-right channel super-directional differential beamforming processing.

The microphone array adjustment module 1105 included in the apparatus is configured to adjust an end-fire direction of the microphone array, such that the end-fire direction points to a target sound source, and the microphone array collects an original audio signal emitted from the target sound source, and transmits the original audio signal to the signal acquiring module 1102 as the audio input signal.

Figure 11C:
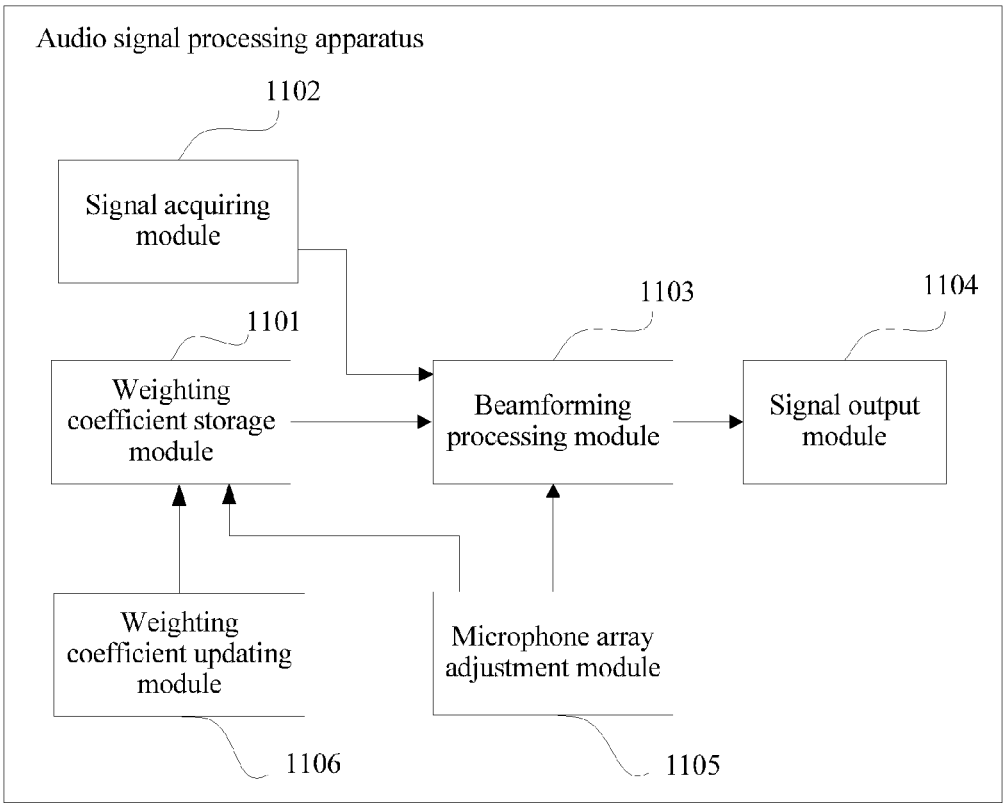

Further, the apparatus further includes a weighting coefficient updating module 1106, as shown in FIG. 11C.

The weighting coefficient updating module 1106 is configured to determine whether an audio collection area is adjusted, if the audio collection area is adjusted, determine a geometric shape of a microphone array, a position of a loudspeaker, and an adjusted audio collection effective area, adjust a beam shape according to the audio collection effective shape, or adjust a beam shape according to the audio collection effective shape and the position of the loudspeaker, in order to obtain an adjusted beam shape, determine the super-directional differential beamforming weighting coefficient according to the geometric shape of the microphone array and the adjusted beam shape, in order to obtain an adjusted weighting coefficient, and transmit the adjusted weighting coefficient to the weighting coefficient storage module 1101.

The weighting coefficient storage module 1101 is further configured to store the adjusted weighting coefficient.

The weighting coefficient updating module 1106 is further configured to determine $D(\omega,\theta)$ and $\beta$ according to the geometric shape of the microphone array and a set audio collection effective area, or determine $D(\omega,\theta)$ and $\beta$ according to the geometric shape of the microphone array, a set audio collection effective area, and the position of the loudspeaker, and determine the super-directional differential beamforming weighting coefficient according to the determined $D(\omega,\theta)$ and $\beta$ using a formula $h(\omega)=D^H(\omega,\theta)[D(\omega,\theta)D^H(\omega,\theta)]^{-1}\beta$, where $h(\omega)$ represents is a weighting coefficient, $D(\omega,\theta)$ represents a steering matrix corresponding to a microphone array in any geometric shape, where the steering matrix is determined according to a relative delay generated when a sound source arrives at each microphone in the microphone array from different incident angles, $D^H(\omega,\theta)$ represents a conjugate transpose matrix of $D(\omega,\theta)$, co represents a frequency of an audio signal, $\theta$ represents an incident angle of the sound source, and $\beta$ represents a response vector when the incident angle is $\theta$.

The weighting coefficient updating module 1106 is further configured to when $D(\omega,\theta)$ and $\beta$ are to be determined according to the geometric shape of the microphone array and the set audio collection effective area, or when $D(\omega,\theta)$ and $\beta$ are to be determined according to the geometric shape of the microphone array, the set audio collection effective area, and the position of the loudspeaker, convert the set audio effective area into a pole direction and a null direction according to output signal types required by different application scenarios, and determine $D(\omega,\theta)$ and $\beta$ in different application scenarios according to the obtained pole direction and the obtained null direction, or according to output signal types required by different application scenarios, convert the set audio effective area into a pole direction and a null direction and convert the position of the loudspeaker into a null direction, and determine $D(\omega,\theta)$ and $\beta$ in different application scenarios according to the obtained pole direction and the obtained null directions, where the pole direction is an incident angle that enables a response value of a super-directional differential beam in this direction to be 1, and the null direction is an incident angle that enables a response value of a super-directional differential beam in this direction to be 0.

The weighting coefficient updating module 1106 is further configured to when $D(\omega,\theta)$ and $\beta$ are to be determined in different application scenarios according to the obtained pole direction and the obtained null direction, and when an output signal type required by an application scenario is a mono signal, set the end-fire direction of the microphone array as the pole direction, and set M null directions, where $M \leq N-1$, and N represents a quantity of microphones in the microphone array, or when an output signal type required by an application scenario is a dual-channel signal, set a 0-degree direction of the microphone array as the pole direction, and set a 180-degree direction of the microphone array as the null direction, in order to determine a super-directional differential beamforming weighting coefficient corresponding to one channel in dual channels, and set the 180-degree direction of the microphone array as the pole direction, and set the 0-degree direction of the microphone array as the null direction, in order to determine a super-directional differential beamforming weighting coefficient corresponding to the other channel.

Figure 11D:
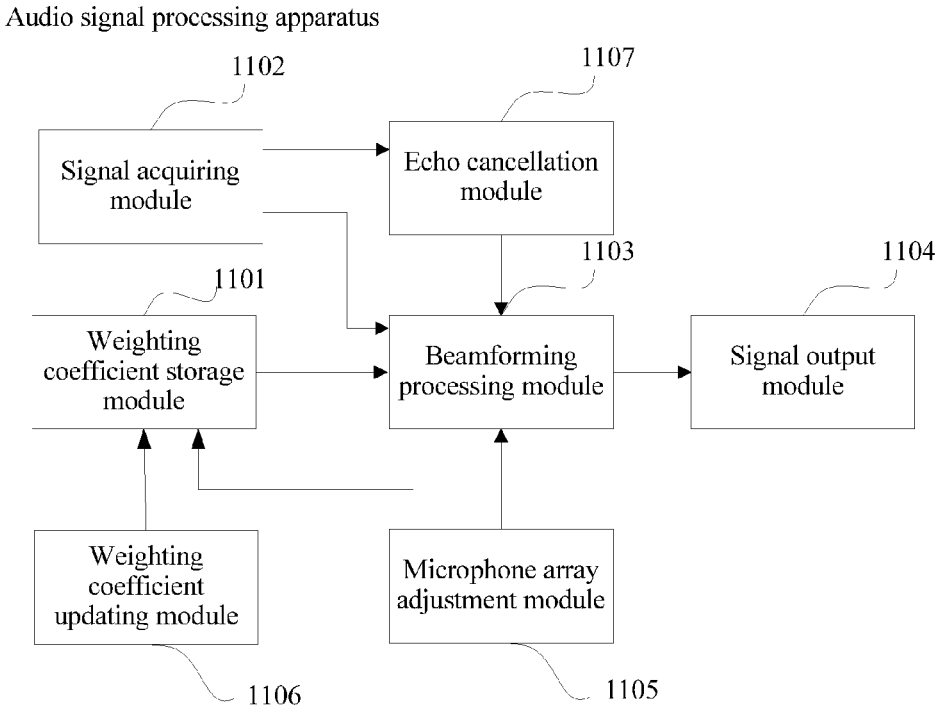

Further, the apparatus further includes an echo cancellation module 1107, as shown in FIG. 11D.

The echo cancellation module 1107 is configured to temporarily store a signal played by a loudspeaker, perform echo cancellation on an original audio signal collected by a microphone array, in order to obtain an echo-canceled audio signal, and transmit the echo-canceled audio signal to the signal acquiring module 1102 as the audio input signal, or is configured to perform echo cancellation on the super-directional differential beamforming signal output by the beamforming processing module 1103, in order to obtain an echo-canceled super-directional differential beamforming signal, and transmit the echo-canceled super-directional differential beamforming signal to the signal output module 1104.

The signal output module 1104 is further configured to output the echo-canceled super-directional differential beamforming signal.

The audio input signal that is required by the current application scenario and is acquired by the signal acquiring module 1102 is an audio signal obtained after echo cancellation is performed, by the echo cancellation module 1107, on the original audio signal collected by the microphone array, or the original audio signal collected by the microphone array.

Figure 11E:
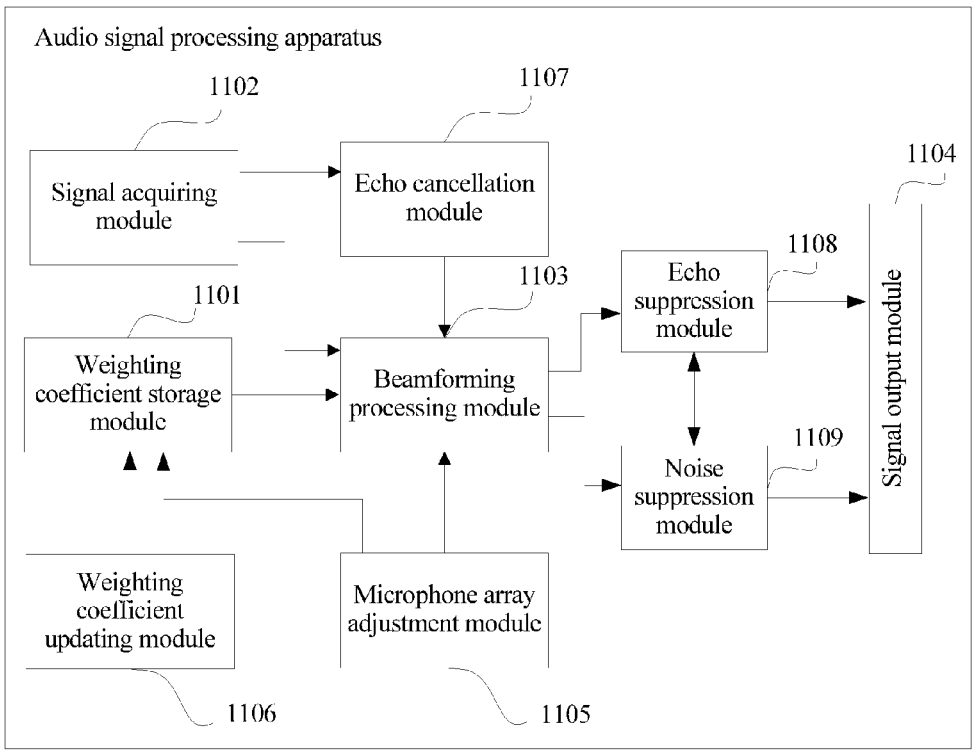

Further, the apparatus further includes an echo suppression module 1108 and a noise suppression module 1109, as shown in FIG. 11E.

The echo suppression module 1108 is configured to perform echo suppression processing on the super-directional differential beamforming signal output by the beamforming processing module 1103.

The noise suppression module 1109 is configured to perform noise suppression processing on an echo-canceled super-directional differential beamforming signal output by the echo suppression module 1108, or the noise suppression module 1109 is configured to perform noise suppression processing on the super-directional differential beamforming signal output by the beamforming processing module 1103.

The echo suppression module 1108 is configured to perform echo suppression processing on a noise-suppressed super-directional differential beamforming signal output by the noise suppression module 1109.

Further, the echo suppression module 1108 is configured to perform echo suppression processing on the super-directional differential beamforming signal output by the beamforming processing module 1103, and the noise suppression module 1109 is configured to perform noise suppression processing on the super-directional differential beamforming signal output by the beamforming processing module 1103.

The signal output module 1104 is further configured to output an echo-suppressed super-directional differential beamforming signal or a noise-suppressed super-directional differential beamforming signal.

Further, the beamforming processing module 1103 is further configured to, when the signal output module 1104 includes the noise suppression module 1109, form, in another direction, except a direction of a sound source, in adjustable end-fire directions of a microphone array, at least one beamforming signal as a reference noise signal, and transmit the formed reference noise signal to the noise suppression module 1109.

Further, when the beamforming processing module 1103 performs super-directional differential beamforming processing, a used super-directional differential beam is a differential beam that is constructed according to a geometric shape of a microphone array and a set beam shape.

According to the audio signal processing apparatus provided in this embodiment of the present disclosure, a beamforming processing module selects a corresponding weighting coefficient from a weighting coefficient storage module according to an output signal type required by a current application scenario, super-directional differential beamforming processing is performed, using the determined weighting coefficient, on an audio input signal output by a signal acquiring module, in order to form a super-directional differential beam in the current application scenario, and corresponding processing is performed on the super-directional differential beam to obtain a final required audio signal. In this way, a requirement that different application scenarios require different audio signal processing manners can be met.

It should be noted that the foregoing audio signal processing apparatus in this embodiment of the present disclosure may be an independent component or may be integrated in another component.

It should be further noted that, for function implementation and an interaction manner of each module/unit in the foregoing audio signal processing apparatus in this embodiment of the present disclosure, reference may be made to descriptions of related method embodiments.

Embodiment 8

Figure 12:
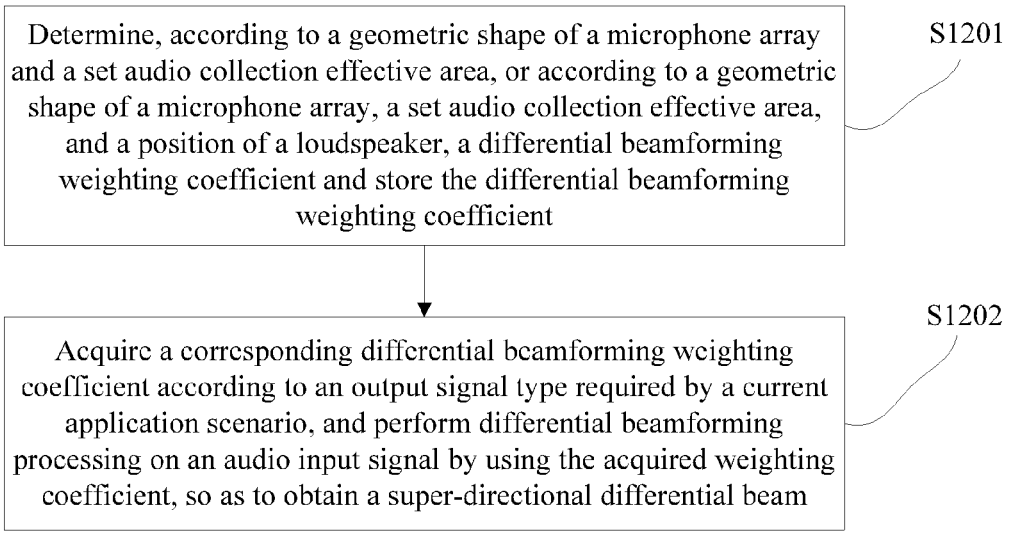
FIG. 12 is a schematic flowchart of differential beamforming method according to an embodiment of the present disclosure.

An embodiment of the present disclosure provides a differential beamforming method. As shown in FIG. 12, the method includes the following steps:

Step S1201: Determine, according to a geometric shape of a microphone array and a set audio collection effective area, a differential beamforming weighting coefficient and store the differential beamforming weighting coefficient, or determine, according to a geometric shape of a microphone array, a set audio collection effective area, and a position of a loudspeaker, a differential beamforming weighting coefficient and store the differential beamforming weighting coefficient.

Step S1202: Acquire, according to an output signal type required by a current application scenario, a differential beamforming weighting coefficient corresponding to the current application scenario, and perform differential beamforming processing on an audio input signal using the acquired weighting coefficient, in order to obtain a super-directional differential beam.

A process of the determining a differential beamforming weighting coefficient further includes determining $D(\omega,\theta)$ and $\beta$ according to the geometric shape of the microphone array and the set audio collection effective area, or determining $D(\omega,\theta)$ and $\beta$ according to the geometric shape of the microphone array, the set audio collection effective area, and the position of the loudspeaker, and determining a super-directional differential beamforming weighting coefficient according to the determined $D(\omega,\theta)$ and $\beta$ using a formula $h(\omega)=D^H(\omega,\theta)[D(\omega,\theta)D^H(\omega,\theta)]^{-1}\beta$, where $h(\omega)$ represents a weighting coefficient, $D(\omega,\theta)$ represents a steering matrix corresponding to a microphone array in any geometric shape, where the steering matrix is determined according to a relative delay generated when a sound source arrives at each microphone in the microphone array from different incident angles, $D^H(\omega,\theta)$ represents a conjugate transpose matrix of $D(\omega,\theta)$, $\omega$ represents a frequency of an audio signal, $\theta$ represents an incident angle of the sound source, and $\beta$ represents a response vector when the incident angle is $\theta$.

The determining $D(\omega,\theta)$ and $\beta$ according to the geometric shape of the microphone array and the set audio collection effective area, or determining $D(\omega,\theta)$ and $\beta$ according to the geometric shape of the microphone array, the set audio collection effective area, and the position of the loudspeaker further includes converting the set audio effective area into a pole direction and a null direction according to output signal types required by different application scenarios, and determining $D(\omega,\theta)$ and $\beta$ in different application scenarios according to the obtained pole direction and the obtained null direction, or according to output signal types required by different application scenarios, converting the set audio effective area into a pole direction and a null direction and converting the position of the loudspeaker into a null direction, and determining $D(\omega,\theta)$ and $\beta$ in different application scenarios according to the obtained pole direction and the obtained null directions, where the pole direction is an incident angle that enables a super-directional differential beam response value of super-directional differential beamforming to be 1, and the null direction is an incident angle that enables a super-directional differential beam response value of super-directional differential beamforming to be 0.

Determining $D(\omega,\theta)$ and $\beta$ in different application scenarios according to the obtained pole direction and the obtained null direction further includes, when an output signal type required by an application scenario is a mono signal, setting an end-fire direction of the microphone array as the pole direction, and setting M null directions, where $M \leq N-1$, and N represents a quantity of microphones in the microphone array, or when an output signal type required by an application scenario is a dual-channel signal, setting a 0-degree direction of the microphone array as the pole direction, and setting a 180-degree direction of the microphone array as the null direction, in order to determine a super-directional differential beamforming weighting coefficient corresponding to one channel in dual channels, and setting the 180-degree direction of the microphone array as the pole direction, and setting the 0-degree direction of the microphone array as the null direction, in order to determine a super-directional differential beamforming weighting coefficient corresponding to the other channel.

According to the differential beamforming method provided in this embodiment of the present disclosure, different weighting coefficients can be determined according to output audio signal types required by different scenarios, and a differential beam that is formed after differential beam processing is performed has relatively high adaptability, which can meet a requirement imposed on a generated beam shape in different scenarios.

It should be noted that, for a differential beamforming process in this embodiment of the present disclosure, reference may further be made to a description of a differential beamforming process in related method embodiments, and details are not described herein again.

Embodiment 9

Figure 13:
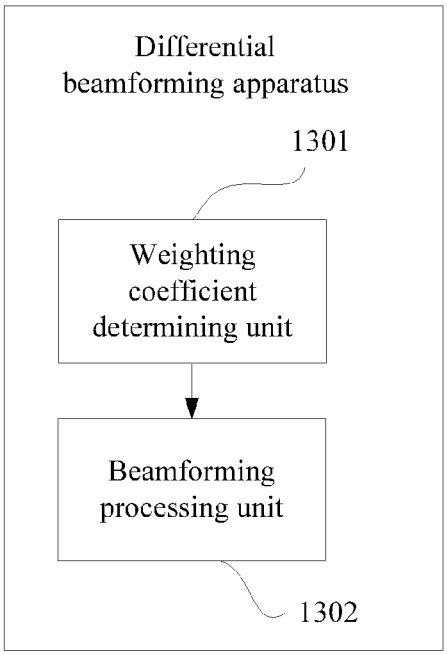
FIG. 13 is a schematic diagram of composition of a differential beamforming apparatus according to an embodiment of the present disclosure.

An embodiment of the present disclosure provides a differential beamforming apparatus. As shown in FIG. 13, the apparatus includes a weighting coefficient determining unit 1301 and a beamforming processing unit 1302.

The weighting coefficient determining unit 1301 is configured to determine a differential beamforming weighting coefficient according to a geometric shape of an omnidirectional microphone array and a set audio collection effective area, and transmit the formed differential beamforming weighting coefficient to the beamforming processing unit 1302, or determine a differential beamforming weighting coefficient according to a geometric shape of an omnidirectional microphone array, a set audio collection effective area, and a position of a loudspeaker, and transmit the formed differential beamforming weighting coefficient to the beamforming processing unit 1302.

The beamforming processing unit 1302 selects a corresponding weighting coefficient from the weighting coefficient determining unit 1301 according to an output signal type required by a current application scenario, and performs differential beamforming processing on an audio input signal using the determined weighting coefficient.

The weighting coefficient determining unit 1301 is further configured to determine $D(\omega,\theta)$ and $\beta$ according to the geometric shape of the microphone array and the set audio collection effective area; or determine $D(\omega,\theta)$ and $\beta$ according to the geometric shape of the microphone array, the set audio collection effective area, and the position of the loudspeaker; and determine a super-directional differential beamforming weighting coefficient according to the determined $D(\omega,\theta)$ and $\beta$ using a formula $h(\omega)=D^H(\omega,\theta)[D(\omega,\theta)D^H(\omega,\theta)]^{-1}\beta$, where $h(\omega)$ represents a weighting coefficient, $D(\omega,\theta)$ represents a steering matrix corresponding to a microphone array in any geometric shape, where the steering matrix is determined according to a relative delay generated when a sound source arrives at each microphone in the microphone array from different incident angles, $D^H(\omega,\theta)$ represents a conjugate transpose matrix of $D(\omega,\theta)$, $\omega$ represents a frequency of an audio signal, $\theta$ represents an incident angle of the sound source, and $\beta$ represents a response vector when the incident angle is $\theta$.

The weighting coefficient determining unit 1301 is further configured to convert the set audio effective area into a pole direction and a null direction according to output signal types required by different application scenarios, and determine $D(\omega,\theta)$ and $\beta$ in different application scenarios according to the obtained pole direction and the obtained null direction, where the pole direction is an incident angle that enables a response value of a to-be-formed super-directional differential beam to be 1, and the null direction is an incident angle that enables a response value of a to-be-formed super-directional differential beam to be 0.

The weighting coefficient determining unit 1301 is further configured to, when an output signal type required by an application scenario is a mono signal, set an end-fire direction of the microphone array as the pole direction, and set M null directions, where $M \leq N-1$, and N represents a quantity of microphones in the microphone array, or when an output signal type required by an application scenario is a dual-channel signal, set a 0-degree direction of the microphone array as the pole direction, and set a 180-degree direction of the microphone array as the null direction, in order to determine a super-directional differential beamforming weighting coefficient corresponding to one channel in dual channels, and set the 180-degree direction of the microphone array as the pole direction, and set the 0-degree direction of the microphone array as the null direction, in order to determine a super-directional differential beamforming weighting coefficient corresponding to the other channel.

The differential beamforming apparatus provided in this embodiment of the present disclosure can determine different weighting coefficients according to audio signal output types required by different scenarios, such that a differential beam formed after differential beam processing is performed has relatively high adaptability, which can meet a requirement on generated beam shapes in different scenarios.

It should be noted that, for a differential beamforming process according to the differential beamforming apparatus in this embodiment of the present disclosure, reference may be made to a description of a differential beamforming process in related method embodiments, and details are not described herein again.

Embodiment 10

Figure 14:
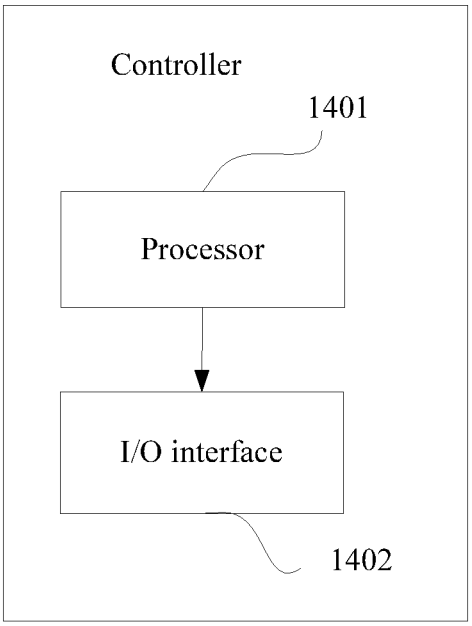
FIG. 14 is a schematic diagram of composition of a controller according to an embodiment of the present disclosure.

On the basis of an audio signal processing method and apparatus, and a differential beamforming method and apparatus provided in the embodiments of the present disclosure, this embodiment of the present disclosure provides a controller. As shown in FIG. 14, the controller includes a processor 1401 and an input/output (I/O) interface 1402.

The processor 1401 is configured to determine super-directional differential beamforming weighting coefficients corresponding to different output signal types in different application scenarios and store the super-directional differential beamforming weighting coefficients. When an audio input signal is acquired and a current application scenario and an output signal type required by the current application scenario are determined, acquire, according to the output signal type required by the current application scenario, a weighting coefficient corresponding to the current application scenario, perform super-directional differential beamforming processing on the acquired audio input signal using the acquired weighting coefficient, in order to obtain a super-directional differential beamforming signal, and transmit the super-directional differential beamforming signal to the I/O interface 1402.

The I/O interface 1402 is configured to output the super-directional differential beamforming signal that is obtained after processing is performed by the processor 1401.

The controller provided in this embodiment of the present disclosure acquires a corresponding weighting coefficient according to an output signal type required by a current application scenario, performs super-directional differential beamforming processing on an audio input signal using the acquired weighting coefficient, in order to form a super-directional differential beam in the current application scenario, and performs corresponding processing on the super-directional differential beam to obtain a final required audio signal. In this way, a requirement that different application scenarios require different audio signal processing manners can be met.

It should be noted that the foregoing controller in this embodiment of the present disclosure may be an independent component or may be integrated in another component.

It should be further noted that, for function implementation and an interaction manner of each module/unit in the foregoing controller in this embodiment of the present disclosure, reference may be made to a description of related method embodiments.

Persons skilled in the art should understand that the embodiments of the present disclosure may be provided as a method, a system, or a computer program product. Therefore, the present disclosure may use a form of hardware only embodiments, software only embodiments, or embodiments with a combination of software and hardware. In addition, the present disclosure may use a form of a computer program product that is implemented on one or more computer-usable storage media (including but not limited to a disk memory, a compact disc-read only memory (CD-ROM), an optical memory, and the like) that include computer-usable program code.

The present disclosure is described with reference to the flowcharts and/or block diagrams of the method, the device (system), and the computer program product according to the embodiments of the present disclosure. It should be understood that computer program instructions may be used to implement each process and/or each block in the flowcharts and/or the block diagrams and a combination of a process and/or a block in the flowcharts and/or the block diagrams. These computer program instructions may be provided for a general-purpose computer, a dedicated computer, an embedded processor, or a processor of any other programmable data processing device to generate a machine, such that the instructions executed by a computer or a processor of any other programmable data processing device generate an apparatus for implementing a specific function in one or more processes in the flowcharts and/or in one or more blocks in the block diagrams.

These computer program instructions may also be stored in a computer readable memory that can instruct the computer or any other programmable data processing device to work in a specific manner, such that the instructions stored in the computer readable memory generate an artifact that includes an instruction apparatus. The instruction apparatus implements a specific function in one or more processes in the flowcharts and/or in one or more blocks in the block diagrams.

These computer program instructions may also be loaded onto a computer or any other programmable data processing device, such that a series of operations and steps are performed on the computer or the any other programmable device, in order to generate computer-implemented processing. Therefore, the instructions executed on the computer or the any other programmable device provide steps for implementing a specific function in one or more processes in the flowcharts and/or in one or more blocks in the block diagrams.

Although some exemplary embodiments of the present disclosure have been described, persons skilled in the art can make changes and modifications to these embodiments once they learn the basic inventive concept. Therefore, the following claims are intended to be construed as to cover the exemplary embodiments and all changes and modifications falling within the scope of the present disclosure.

Obviously, persons skilled in the art can make various modifications and variations to the embodiments of the present disclosure without departing from the spirit and scope of the embodiments of the present disclosure. The present disclosure is intended to cover these modifications and variations provided that they fall within the scope defined by the following claims and their equivalent technologies.

What is claimed is:

1. An audio signal processing apparatus, comprising a non-transitory memory storing instructions; and a processor coupled to the non-transitory memory and configured to execute the instructions to:

store a super-directional differential beamforming weighting coefficient;

acquire an audio input signal;

output the audio input signal;

determine a current application scenario and an output signal type required by the current application scenario;

transmit the current application scenario and the output signal type required by the current application scenario;

acquire, according to the output signal type required by the current application scenario, a weighting coefficient corresponding to the current application scenario;

perform super-directional differential beamforming processing on the audio input signal using the acquired weighting coefficient in order to obtain a super-directional differential beamforming signal;

transmit the super-directional differential beamforming signal;

output the super-directional differential beamforming signal;

acquire an audio-left channel super-directional differential beamforming weighting coefficient and an audio-right channel super-directional differential beamforming weighting coefficient when the output signal type required by the current application scenario is a dual-channel signal type;

perform super-directional differential beamforming processing on the audio input signal according to the audio-left channel super-directional differential beamforming weighting coefficient in order to obtain an audio-left channel super-directional differential beamforming signal;

perform super-directional differential beamforming processing on the audio input signal according to the audio-right channel super-directional differential beamforming weighting coefficient in order to obtain an audio-right channel super-directional differential beamforming signal;

transmit the audio-left channel super-directional differential beamforming signal and the audio-right channel super-directional differential beamforming signal; and output the audio-left channel super-directional differential beamforming signal and the audio-right channel super-directional differential beamforming signal.

2. The apparatus according to claim 1, wherein the processor is further configured to execute the instructions to:

acquire a mono super-directional differential beamforming weighting coefficient corresponding to the current application scenario when the output signal type required by the current application scenario is a mono signal type;

perform super-directional differential beamforming processing on the audio input signal according to the mono super-directional differential beamforming weighting coefficient in order to form one mono super-directional differential beamforming signal;

transmit the one mono super-directional differential beamforming signal; and output the one mono super-directional differential beamforming signal.

3. The apparatus according to claim 1, wherein the processor is further configured to execute the instructions to:

adjust a microphone array to form a first subarray and a second subarray, wherein an end-fire direction of the first subarray is different from an end-fire direction of the second subarray, and wherein the first subarray and the second subarray each collect an original audio signal; and transmit the original audio signal as the audio input signal.

4. The apparatus according to claim 1, wherein the processor is further configured to execute the instructions to:

adjust an end-fire direction of a microphone array, such that the end-fire direction points to a target sound source;

collect an original audio signal emitted from the target sound source; and transmit the original audio signal as the audio input signal.

5. The apparatus according to claim 1, wherein the processor is further configured to execute the instructions to:

determine whether an audio collection area is adjusted;

determine a geometric shape of a microphone array, a position of a loudspeaker, and an adjusted audio collection effective area when the audio collection area is adjusted;

adjust a beam shape according to the audio collection effective area, or adjust the beam shape according to the audio collection effective area and the position of the loudspeaker in order to obtain an adjusted beam shape;

determine the super-directional differential beamforming weighting coefficient according to the geometric shape of the microphone array and the adjusted beam shape in order to obtain an adjusted weighting coefficient;

transmit the adjusted weighting coefficient; and store the adjusted weighting coefficient.

6. An audio signal processing method, comprising:

determining a super-directional differential beamforming weighting coefficient;

acquiring an audio input signal;

determining a current application scenario and an output signal type required by the current application scenario;

acquiring, according to the output signal type required by the current application scenario, a weighting coefficient corresponding to the current application scenario;

performing super-directional differential beamforming processing on the audio input signal using the acquired weighting coefficient in order to obtain a super-directional differential beamforming signal;

outputting the super-directional differential beamforming signal; and wherein acquiring, according to the output signal type required by the current application scenario, the weighting coefficient corresponding to the current application scenario, performing super-directional differential beamforming processing on the audio input signal using the acquired weighting coefficient in order to obtain the super-directional differential beamforming signal, and outputting the super-directional differential beamforming signal comprises:

acquiring an audio-left channel super-directional differential beamforming weighting coefficient and an audio-right channel super-directional differential beamforming weighting coefficient when the output signal type required by the current application scenario is a dual-channel signal type;

performing super-directional differential beamforming processing on the audio input signal according to the audio-left channel super-directional differential beamforming weighting coefficient in order to obtain an audio-left channel super-directional differential beamforming signal;

performing super-directional differential beamforming processing on the audio input signal according to the audio-right channel super-directional differential beamforming weighting coefficient in order to obtain an audio-right channel super-directional differential beamforming signal; and outputting the audio-left channel super-directional differential beamforming signal and the audio-right channel super-directional differential beamforming signal.

7. The audio signal processing method according to claim 6, wherein acquiring, according to the output signal type required by the current application scenario, the weighting coefficient corresponding to the current application scenario, wherein performing super-directional differential beamforming processing on the audio input signal using the acquired weighting coefficient in order to obtain the super-directional differential beamforming signal, and wherein outputting the super-directional differential beamforming signal further comprises:

acquiring a mono super-directional differential beamforming weighting coefficient for forming a mono signal in the current application scenario when the output signal type required by the current application scenario is a mono signal type;

performing super-directional differential beamforming processing on the audio input signal according to the acquired mono super-directional differential beamforming weighting coefficient in order to form one mono super-directional differential beamforming signal; and outputting the one mono super-directional differential beamforming signal.

8. The audio signal processing method according to claim 6, wherein before acquiring the audio input signal, the method further comprises:

adjusting a microphone array to form a first subarray and a second subarray, wherein an end-fire direction of the first subarray is different from an end-fire direction of the second sub array;

collecting an original audio signal using each of the first subarray and the second sub array; and using the original audio signal as the audio input signal.

9. The audio signal processing method according to claim 6, wherein before acquiring the audio input signal, the method further comprises:

adjusting an end-fire direction of a microphone array, such that the end-fire direction points to a target sound source;

collecting an original audio signal of the target sound source; and using the original audio signal as the audio input signal.

10. The audio signal processing method according to claim 6, wherein before acquiring, according to the output signal type required by the current application scenario, the weighting coefficient corresponding to the current application scenario, the method further comprises:

determining whether an audio collection area is adjusted;

determining a geometric shape of a microphone array, a position of a loudspeaker, and an adjusted audio collection effective area when the audio collection area is adjusted;

adjusting a beam shape according to the audio collection effective area, or adjusting the beam shape according to the audio collection effective area and the position of the loudspeaker in order to obtain an adjusted beam shape;

determining the super-directional differential beamforming weighting coefficient according to the geometric shape of the microphone array and the adjusted beam shape in order to obtain an adjusted weighting coefficient; and performing super-directional differential beamforming processing on the audio input signal using the adjusted weighting coefficient.

11. The audio signal processing method according to claim 6, further comprising:

performing echo cancellation on an original audio signal collected by a microphone array;

or performing echo cancellation on the super-directional differential beamforming signal.

12. The audio signal processing method according to claim 6, wherein after the super-directional differential beamforming signal is formed, the method further comprises performing echo suppression processing and/or noise suppression processing on the super-directional differential beamforming signal.

13. The audio signal processing method according to claim 6, further comprising:

forming, in another direction, except a direction of a sound source, in adjustable end-fire directions of a microphone array, at least one beamforming signal as a reference noise signal; and performing noise suppression processing on the super-directional differential beamforming signal using the reference noise signal.

14. A differential beamforming apparatus, comprising:

a non-transitory memory storing instructions; and a processor coupled to the non-transitory memory and configured to execute the instructions to:

determine a differential beamforming weighting coefficient according to a geometric shape of a microphone array and a set audio collection effective area, or determine the differential beamforming weighting coefficient according to the geometric shape of the microphone array, the set audio collection effective area, and a position of a loudspeaker;

transmit the formed weighting coefficient;

acquire, according to an output signal type required by a current application scenario, a weighting coefficient corresponding to the current application scenario; and perform differential beamforming processing on an audio input signal using the acquired weighting coefficient.

15. The apparatus according to claim 14, wherein the processor is further configured to execute the instructions to:

determine $D(\omega,\theta)$ and $\beta$ according to the geometric shape of the microphone array and the set audio collection effective area; or determine $D(\omega,\theta)$ and $\beta$ according to the geometric shape of the microphone array, the set audio collection effective area, and the position of the loudspeaker; determine a super-directional differential beamforming weighting coefficient according to the determined $D(\omega,\theta)$ and $\beta$ using a formula $h(\omega)=D^H(\omega,\theta)[D(\omega,\theta)D^H(\omega,\theta)]^{-1}\beta$, wherein the $h(\omega)$ represents a weighting coefficient, the $D(\omega,\theta)$ represents a steering matrix corresponding to the microphone array in any geometric shape, wherein the steering matrix is determined according to a relative delay generated when a sound source arrives at each microphone in the microphone array from different incident angles, wherein the $D^H(\omega,\theta)$ represents a conjugate transpose matrix of $D(\omega,\theta)$, wherein the w represents a frequency of an audio signal, wherein the $\theta$ represents an incident angle of the sound source, and wherein the $\beta$ represents a response vector when the incident angle is $\theta$.

16. The apparatus according to claim 15, wherein the processor is further configured to execute the instructions to:

convert the set audio effective area into a pole direction and a null direction according to output signal types required by different application scenarios;

determine $D(\omega,\theta)$ and $\beta$ in different application scenarios according to the obtained pole direction and the obtained null direction; or convert the set audio effective area into the pole direction and the null direction according to output signal types required by different application scenarios;

convert the position of the loudspeaker into the null direction; and determine $D(\omega,\theta)$ and $\beta$ in different application scenarios according to the obtained pole direction and the obtained null directions, wherein the pole direction is an incident angle that enables a response value of a super-directional differential beam in this direction to be 1, and wherein the null direction is an incident angle that enables the response value of the super-directional differential beam in this direction to be 0.

17. The apparatus according to claim 16, wherein the processor is further configured to execute the instructions to:

set an end-fire direction of the microphone array as the pole direction when the output signal type required by an application scenario is a mono signal type;

set M null directions when the output signal type required by the application scenario is the mono signal type, wherein $M \leq N-1$, and wherein N represents a quantity of microphones in the microphone array;

set a 0-degree direction of the microphone array as the pole direction when the output signal type required by the application scenario is a dual-channel signal type;

set a 180-degree direction of the microphone array as the null direction in order to determine the super-directional differential beamforming weighting coefficient corresponding to one channel in dual channels when the output signal type required by the application scenario is the dual-channel signal type;

set the 180-degree direction of the microphone array as the pole direction in order to determine the super-directional differential beamforming weighting coefficient corresponding to the other channel; and set the 0-degree direction of the microphone array as the null direction in order to determine the super-directional differential beamforming weighting coefficient corresponding to the other channel.

* * * * *